US008840109B2

(12) United States Patent
Sato

(10) Patent No.: US 8,840,109 B2
(45) Date of Patent: Sep. 23, 2014

(54) IMAGE FORMING APPARATUS

(71) Applicant: Oki Data Corporation, Tokyo (JP)

(72) Inventor: Osamu Sato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/061,909

(22) Filed: Oct. 24, 2013

(65) Prior Publication Data

US 2014/0117613 A1 May 1, 2014

(30) Foreign Application Priority Data

Oct. 26, 2012 (JP) ..... 2012-236471

(51) Int. Cl.
*B65H 5/02* (2006.01)
*B65H 5/06* (2006.01)
*B65H 3/44* (2006.01)

(52) U.S. Cl.
CPC . *B65H 3/44* (2013.01); *B65H 5/062* (2013.01)
USPC ..... 271/272; 271/273

(58) Field of Classification Search
CPC .. B65H 5/062; B65H 29/125; B65H 2402/31; B65H 2402/14; B65H 2403/40
USPC ..... 271/272, 273
See application file for complete search history.

(56) References Cited

U.S. PATENT DOCUMENTS

| | | | | |
|---|---|---|---|---|
| 8,028,992 | B2 * | 10/2011 | Terao | 271/273 |
| 8,360,425 | B2 * | 1/2013 | Chng et al. | 271/273 |
| 2006/0145416 | A1 * | 7/2006 | Giese | 271/273 |
| 2011/0262200 | A1 * | 10/2011 | Shiba | 399/396 |
| 2012/0248693 | A1 * | 10/2012 | Gayne et al. | 271/273 |

FOREIGN PATENT DOCUMENTS

JP H08-72344 A 3/1996

* cited by examiner

*Primary Examiner* — David H Bollinger
(74) *Attorney, Agent, or Firm* — Panitch Schwarze Belisario & Nadel LLP

(57) ABSTRACT

An image forming apparatus includes first and second units including first and second feeding members respectively for feeding a medium, and a medium feeding path provided between the first and second units. The second unit is movable between a closing position where the medium feeding path is formed between the first unit and the second unit and an opening position where the second unit separates from the first unit to open the medium feeding path. The second feeding member has a second gear that meshes with a first gear of the first feeding member when the second unit is in the closing position. When the second unit moves to the closing position, a shift mechanism holds one of the first gear and the second gear at a retracted position where the first gear and the second gear do not mesh with each other.

16 Claims, 21 Drawing Sheets

IMAGE FORMING APPARATUS

BACKGROUND OF THE INVENTION

The present invention relates to an image forming apparatus configured to feed a medium (for example, a recording medium or a reading medium) and form an image. Particularly, the present invention relates to the image forming apparatus having a configuration facilitating removal of a jammed medium.

A general image forming apparatus is configured to feed a medium using a pair of feeding rollers nipping the medium therebetween. For example, Japanese Laid-open Publication No. H08-72344 (see FIG. 1) discloses an image forming apparatus having a configuration for preventing separation of gears of the feeding rollers when feeding a thick medium or a plurality of stacked media.

However, in the general image forming apparatus, there is a possibility that the medium may be jammed. Particularly, if the medium is damaged (for example, torn), the medium may be caught between guide members of a medium feeding path and may be cut into fine pieces. In such a case, it is troublesome to remove the medium (i.e., the fine pieces) from the image forming apparatus.

In order to facilitate removal of the jammed medium, the image forming apparatus may be configured to be divisible into two units at the medium feeding path. However, in such a case, when the two units are joined, gears of the feeding rollers (mounted to the respective units) may hit each other. Therefore, the gears of the feeding rollers may be damaged.

SUMMARY OF THE INVENTION

An aspect of the present invention is intended to provide an image forming apparatus capable of facilitating removal of a jammed medium and preventing damage to gears.

According to an aspect of the present invention, there is provided an image forming apparatus including a first unit including a first feeding member for feeding a medium, a second unit including a second feeding member for feeding the medium, and a medium feeding path provided between the first unit and the second unit. The second unit is movable between a closing position where the medium feeding path is formed between the first unit and the second unit and an opening position where the second unit separates from the first unit so as to open the medium feeding path. The first feeding member has a first gear. The second feeding member has a second gear that meshes with the first gear when the second unit is in the closing position. The image forming apparatus further comprises a shift mechanism. When the second unit moves to the closing position, the shift mechanism holds one of the first gear and the second gear at a retracted position where the first gear and the second gear do not mesh with each other.

With such a configuration, a jammed medium can be easily removed from the image forming apparatus, and damage to the first and second gears can be prevented.

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Hereinafter, a belt unit and an image forming apparatus according to embodiments of the present invention will be described with reference to drawings.

First Embodiment

Configuration of Image Forming Apparatus

Figure 1:
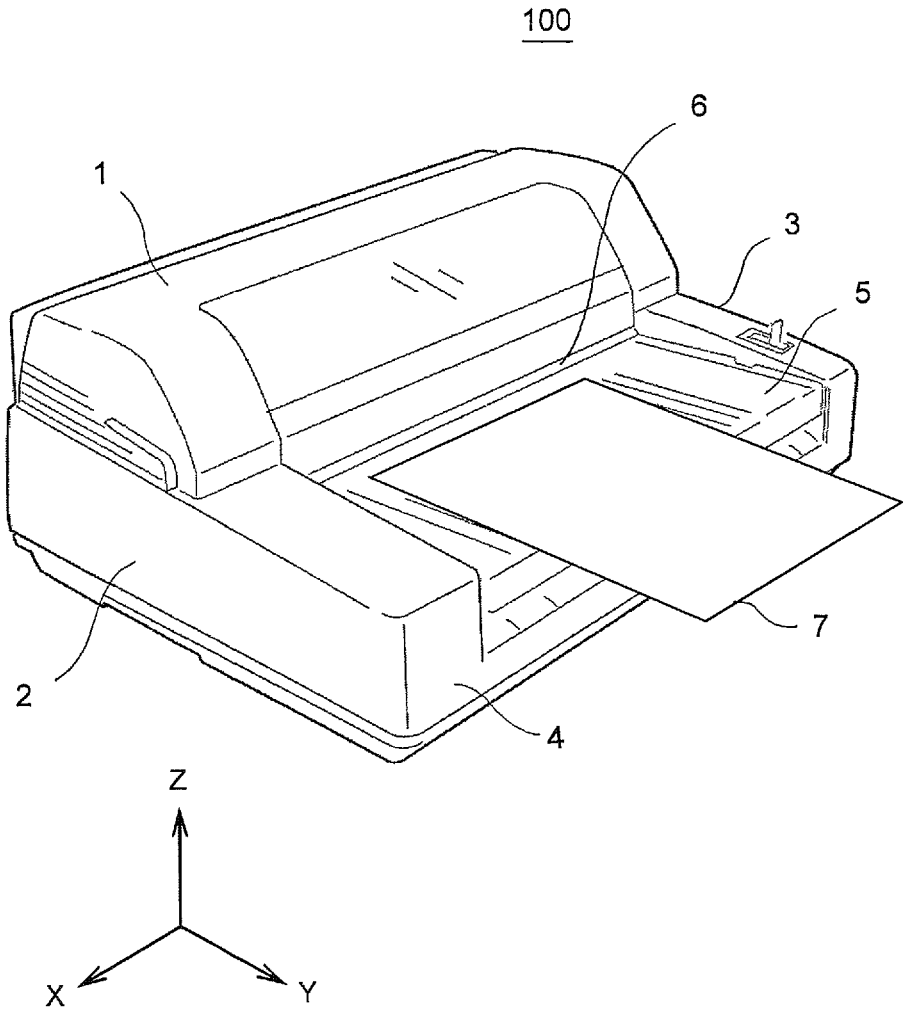
FIG. 1 is a perspective view showing an external shape of an image forming apparatus according to the first embodiment of the present invention.

FIG. 1 is a perspective view showing an external shape of an image forming apparatus according to the first embodiment of the present invention. The image forming apparatus 100 has a main body cover including an upper cover 1, side covers 2 and 3, and a lower cover 4. The image forming apparatus 100 has an elongated shape.

In FIG. 1, a longitudinal direction of the image forming apparatus 100 is referred to as X direction, a widthwise direction of the image forming apparatus 100 is referred to as Y direction. An XY plane (parallel to the X direction and the Y direction) is a horizontal plane. A direction perpendicular to the XY plane is referred to as Z direction (i.e., a vertical direction). The X, Y and Z directions are provided for convenience of explanation, and do not limit an orientation of the image forming apparatus 100.

A medium insertion opening 6 is provided on a front surface (i.e., a surface facing +Y direction) of the upper cover 1. The medium insertion opening 6 is provided for inserting a medium (for example, a printing medium) 7 into the image forming apparatus 100. A stage 5 is provided on the lower cover 4. The stage 5 functions as a guide member for guiding the medium 7 inserted through the medium insertion opening 6.

Figure 2:
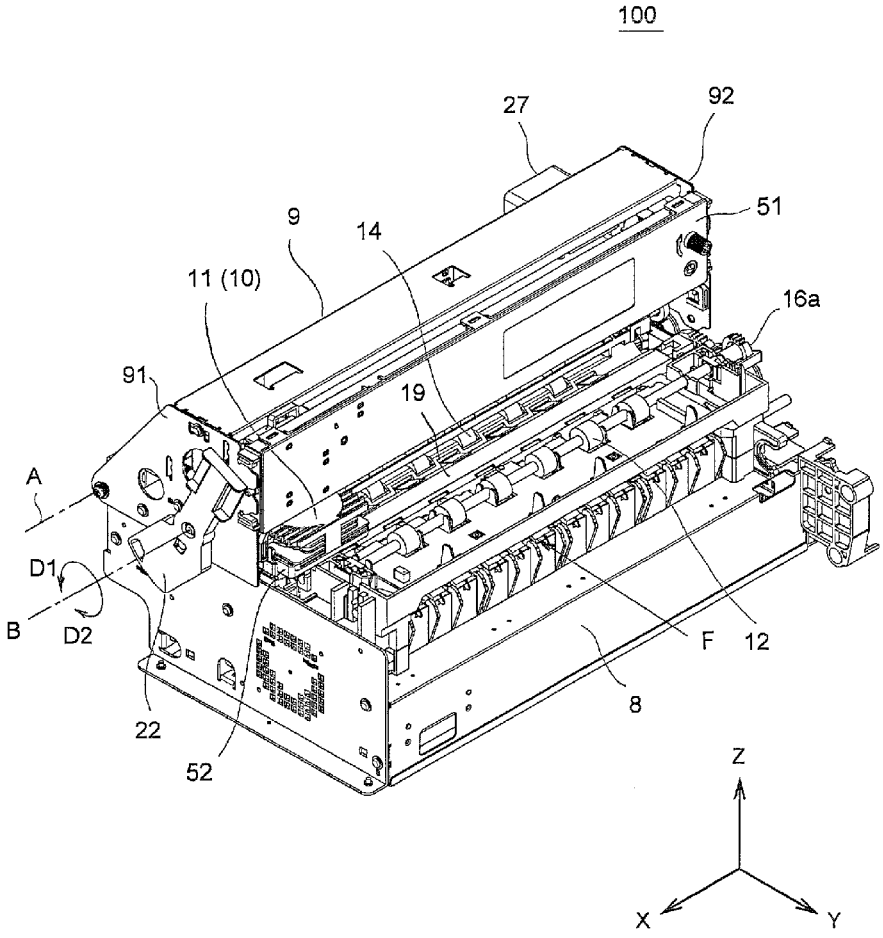
FIG. 2 is a perspective view showing the image forming apparatus according to the first embodiment from which an upper cover, a side cover, a lower cover and a stage are removed.
Figure 3:
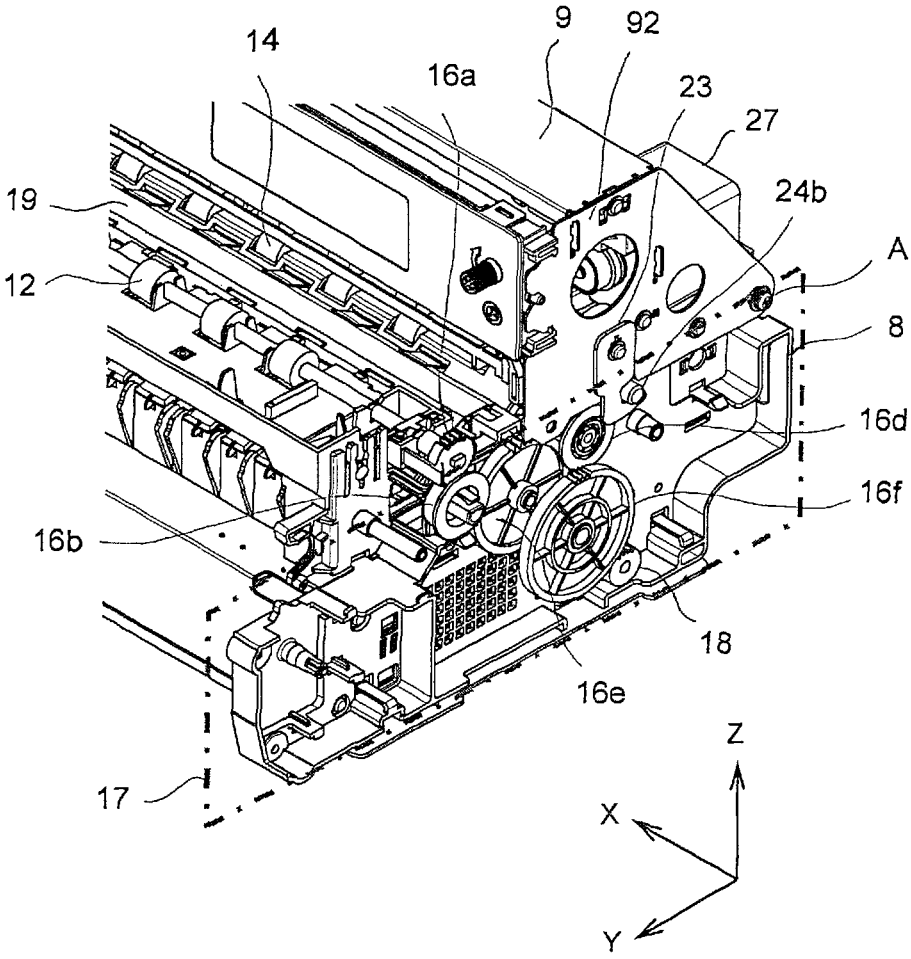
FIG. 3 is an enlarged perspective view showing a main part of the image forming apparatus according to the first embodiment.

FIG. 2 is a perspective view showing the image forming apparatus 100 from which the upper cover 1, the side cover 2 and 3, the lower cover 4 and the stage 5 are removed. FIG. 3 is an enlarged perspective view showing a main part of the image forming apparatus 100. The image forming apparatus 100 includes a lower frame unit 8 as a first unit, and an upper frame unit 9 as a second unit. The upper frame unit 9 is mounted to the lower frame unit 8 so as to be rotatable about a rotation axis A extending in the X direction.

A medium feeding path F for feeding the medium 7 is formed between the lower frame unit 8 and the upper frame unit 9. A feeding mechanism (i.e., a feeding driving unit 17 described later) is mounted on the lower frame unit 8. The feeding driving unit 17 (FIG. 3) is configured to feed the medium 7 along the medium feeding path F. A carriage unit 11 (FIG. 4) is mounted on the upper frame unit 9. The carriage unit 11 (i.e., a carriage) includes a print head 10 (i.e., a head unit) that forms an image on the medium 7 fed along the medium feeding path 9. In this way, the image forming apparatus includes two upper and lower units, i.e., the upper frame unit 9 and the lower frame unit 8.

Figure 4:
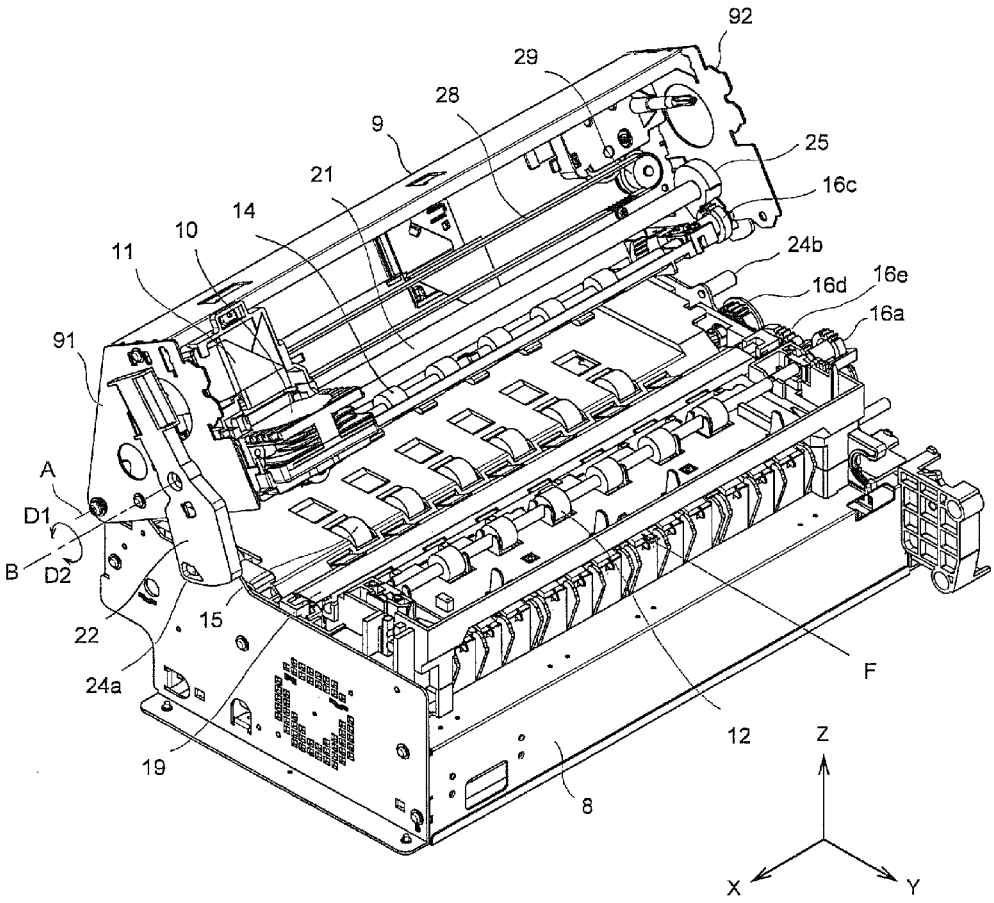
FIG. 4 is a perspective view showing the image forming apparatus according to the first embodiment in a state where an upper frame unit is opened.

FIG. 4 is a perspective view showing the image forming apparatus 100 in a state where the upper frame unit 9 is in an upward position (i.e., an opening position). A front upper roller 12 and a front lower roller 13 are mounted to the lower frame unit 8. The front lower roller 13 (not shown in FIG. 4) is disposed on a lower side (i.e., −Z side) of the front upper roller 12. The front upper roller 12 and the front lower roller 13 constitute front rollers (or a front roller pair). The front upper roller 12 has a plurality of roller parts arranged on a common rotation shaft extending in the X direction. The front lower roller 13 has a plurality of roller parts arranged on a common rotation shaft extending in the X direction. The front upper roller 12 rotates in an opposite direction to the front lower roller 13. In other words, at a portion where the front upper roller 12 faces the front lower roller 13, a circumferential surface of the front upper roller 12 moves in the same direction as a circumferential surface of the front lower roller 13.

A rear lower roller 15 (i.e., a first feeding member) is mounted to the lower frame unit 8 and is disposed on −Y side of the front rollers 12 and 13. A rear upper roller 14 (i.e., a second feeding member) is mounted to the upper frame unit 9 and is disposed on an upper side (i.e., +Z side) of the rear lower roller 15. The rear lower roller 15 and the rear upper roller 14 constitute rear rollers (i.e., a rear roller pair). The rear upper roller 14 has a plurality of roller parts arranged along a common rotation shaft extending in the X direction. The rear lower roller 15 has a plurality of roller parts arranged along a common rotation shaft extending in the X direction. The rear upper roller 14 rotates in an opposite direction to the rear lower roller 15. In other words, at a portion where the rear upper roller 14 faces the rear lower roller 15, a circumferential surface of the rear upper roller 14 moves in the same direction as a circumferential surface of the rear lower roller 15.

As shown in FIG. 3, gears 16*a*, 16*b*, 16*c* and 16*d* are fixed to ends (on −X side) of the respective rotation shafts of the front rollers 12 and 13 and the rear rollers 14 and 15. In this regard, the gear 16*c* is not shown in FIG. 3, but is shown in FIG. 4. The gear 16*a* of the front upper roller 12 and the gear 16*b* of the front lower roller 13 mesh with each other. The gear 16*c* (i.e., a second gear) of the rear upper roller 14 and the gear 16*d* (i.e., a first gear) of the rear lower roller 15 mesh with each other.

As shown in FIG. 3, a transmission gear 16*e* is provided between the gear 16*b* of the front lower roller 13 and the gear 16*d* of the rear lower roller 15. The transmission gear 16*e* meshes with the gear 16*b* of the front lower roller 13 and the gear 16*d* of the rear lower roller 15. The transmission gear 16*e* is linked with a feeding motor 18 via a reduction gear 16*f*. The feeding motor 18 is provided in the lower frame unit 8. With such an arrangement, a driving force of the feeding motor 18 is transmitted to the gears 16*a*, 16*b*, 16*c* and 16*d*, and the front rollers 12 and 13 and the rear rollers 14 and 15 rotate so as to feed the medium 7 in the +Y direction or the −Y direction. The feeding motor 18 and the gears 16*a*, 16*b*, 16*c*, 16*d* and 16*e* constitute the feeding driving unit 17 shown by a dashed line in FIG. 3.

As shown in FIG. 4, a platen 19 is provided between the front rollers 12 and 13 and the rear rollers 14 and 15 in the feeding direction of the medium 7 (i.e., the Y direction). The platen 19 has an elongated shape in the X direction.

A carriage shaft 21 (i.e., a shaft) is mounted to the upper frame unit 9, and is disposed on an upper side (i.e., the +Z side) of the platen 19. An axial direction of the carriage shaft is parallel to the X direction. The carriage unit 11 is mounted to the carriage shaft 21 so as to be movable in the X direction.

The print head 10 is mounted on the carriage unit 11. The print head 10 (i.e., a head unit) is configured to form an image on the medium 7. The print head 10 has a head nose facing the platen 19.

An ink ribbon cassette 51 (FIG. 2) is detachably mounted to the upper frame unit 9. The ink ribbon cassette 51 stores an ink ribbon therein. The ink ribbon is guided by a ribbon guide 52 (FIG. 2) detachably mounted to the carriage unit 11, and runs through between the head nose of the print head 10 and the platen 19. Structures of the print head 10 and the ink ribbon cassette 51 are known, and therefore detailed explanations thereof are omitted.

A belt body 28, a driving pulley 29 and a driven pulley (not shown) are provided on the upper frame unit 9 for moving the carriage unit 11 in the X direction. The belt body 28 is stretched around the driving pulley 29 and the driven pulley. The belt body 28 is fixed to the carriage unit 11. The driving pulley 29 is rotated by a carriage driving motor 27 (FIG. 2) mounted to the upper frame unit 9.

When the driving pulley 29 is rotated by a driving force of the carriage driving motor 27, the belt body 28 runs, and the carriage unit 11 moves along the carriage shaft 21 in the X direction. A standby position is provided in a movable range of the carriage unit 11. The standby position is disposed outside the medium feeding path F in the X direction.

While the carriage unit 11 is moved in the X direction, a wire protrudes from the head nose of the print head 10, and impacts the platen 19. The medium 7 and the ink ribbon are interposed between the platen 19 and the wire, and therefore an ink of the ink ribbon is transferred to the medium 7 by impact applied by the wire. In this way, a line image (i.e., a one-dimensional image) in the X direction is formed on the medium 7. Line images in the X direction are formed on the medium 7 while the medium 7 is fed in the Y direction by the front rollers 12 and 13 and the rear rollers 14 and 15. As a result, a two-dimensional image is formed on the medium 7.

Next, a configuration for rotating (i.e., opening and closing) the upper frame unit 9 with respect to the lower frame unit 8 will be described.

As described above, the upper frame unit 9 is rotatable about the rotation axis A extending in the X direction. The upper frame unit 9 is rotatable between a closing position (FIG. 2) and an upper position (FIG. 4). In the closing position, the upper frame unit 9 is seated on the lower frame unit 8. In the opening position, the upper frame unit 9 is rotated upward from the lower frame unit 8. When the upper frame unit 9 is in the closing position, the medium feeding path F is formed between the upper frame unit 9 and the lower frame unit 8. When the upper frame unit 9 is in the opening position, the medium feeding path F is opened.

A tilt lever 22 (i.e., a rotation locking mechanism) is mounted on the +X side (i.e., a left side in FIG. 4) of the upper frame unit 9. A lock lever 23 (i.e., a rotation holding member) is mounted on the −X side (i.e., a right side in FIG. 4) of the upper frame unit 9.

Figure 5A:
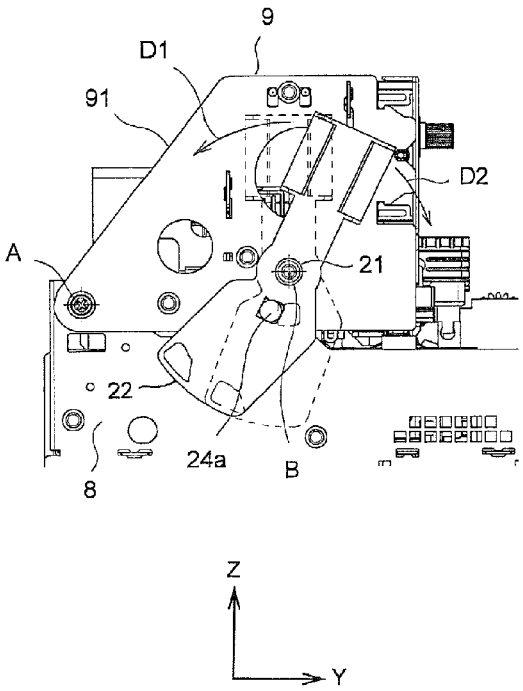
FIG. 5A is a side view showing the upper frame unit of the image forming apparatus according to the first embodiment.
Figure 5B:
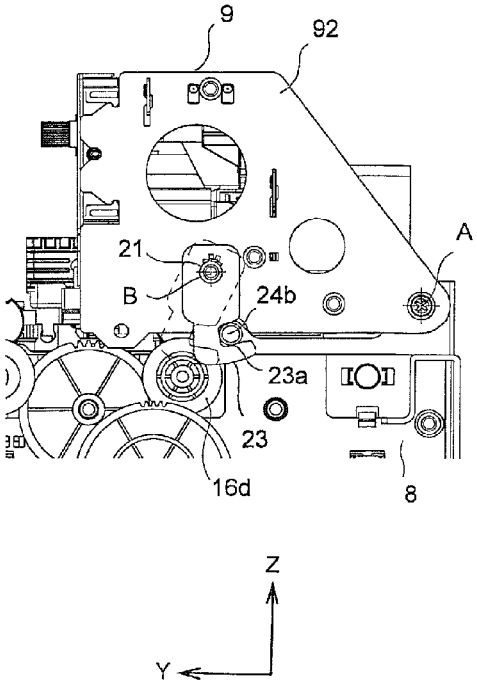
FIG. 5B is a side view showing the upper frame unit of the image forming apparatus according to the first embodiment as seen in the opposite direction to FIG. 5A.

FIG. 5A is a side view showing the upper frame unit 9 as seen from the +X side. FIG. 5B is a side view showing the upper frame unit 9 as seen from the −X side.

As shown in FIG. 5A, the tilt lever 22 is rotatably mounted to an outer side of a side plate 91 of the upper frame unit 9 via a not shown bearing. The tilt lever 22 is fixed to the carriage shaft 21 mounted to the upper frame unit 9. An end portion of the carriage shaft 21 in the +X direction is formed to have a D-shaped cross section (see FIG. 6). The tilt lever 22 has an engaging hole having a D-shape so as to engage the end portion of the carriage shaft 21. With such an arrangement, the tilt lever 22 rotates together with the carriage shaft 21 about a center axis B of the carriage shaft 21.

The tilt lever 22 has groove portions 22*a*, 22*b* and 22*c* that successively engage a boss 24*a* (i.e., an engaging portion) of the lower frame unit 8. The boss 24*a* is formed on the +X side of the lower frame unit 8. As the groove portions 22*a*, 22*b* and 22*c* successively engage the boss 24*a*, the tilt lever 22 guides a rotation of the upper frame unit 9 or locks the rotation of the upper frame unit 9.

When the tilt lever 22 is in a rotational position as shown by a solid line in FIG. 5A, the tilt lever 22 locks the upper frame unit 9 at the closing position with respect to the lower frame unit 8 as described later. When the tilt lever 22 is in a rotational position as shown by a dashed line in FIG. 5A, the tilt lever 22 releases locking of the upper frame unit 9 as described later.

As shown in FIG. 5B, the lock lever 23 is rotatably mounted to a side plate 92 of the upper frame unit 9 via a not shown bearing. The lock lever 23 is fixed to the carriage shaft 21. An end portion of the carriage shaft 21 in the −X direction is formed to have a D-shaped cross section. The lock lever 23 has an engaging hole having a D-shape so as to engage the end portion of the carriage shaft 21. With such an arrangement, the lock lever 23 rotates together with the carriage shaft 21 about the center axis B of the carriage shaft 21.

The lock lever 23 has an engaging groove 23*a* that engages a boss 24*b* (i.e., an engaging portion) of the lower frame unit 8. The boss 24*b* is formed on the −X side of the lower frame unit 8. When the engaging groove 23*a* engages the boss 24*b*, the lock lever 23 locks the rotation of the upper frame unit 9.

When the lock lever 23 is in a rotational position as shown by a solid line in FIG. 5B, the engaging groove 23*a* engages the boss 24*b* to lock the upper frame unit 9 at the closing position with respect to the lower frame unit 8. When the lock lever 23 is in a rotational position as shown by a dashed line in FIG. 5B, the engaging groove 23*a* disengages from the boss 24*b* to release the locking of the upper frame unit 9.

Figure 6:
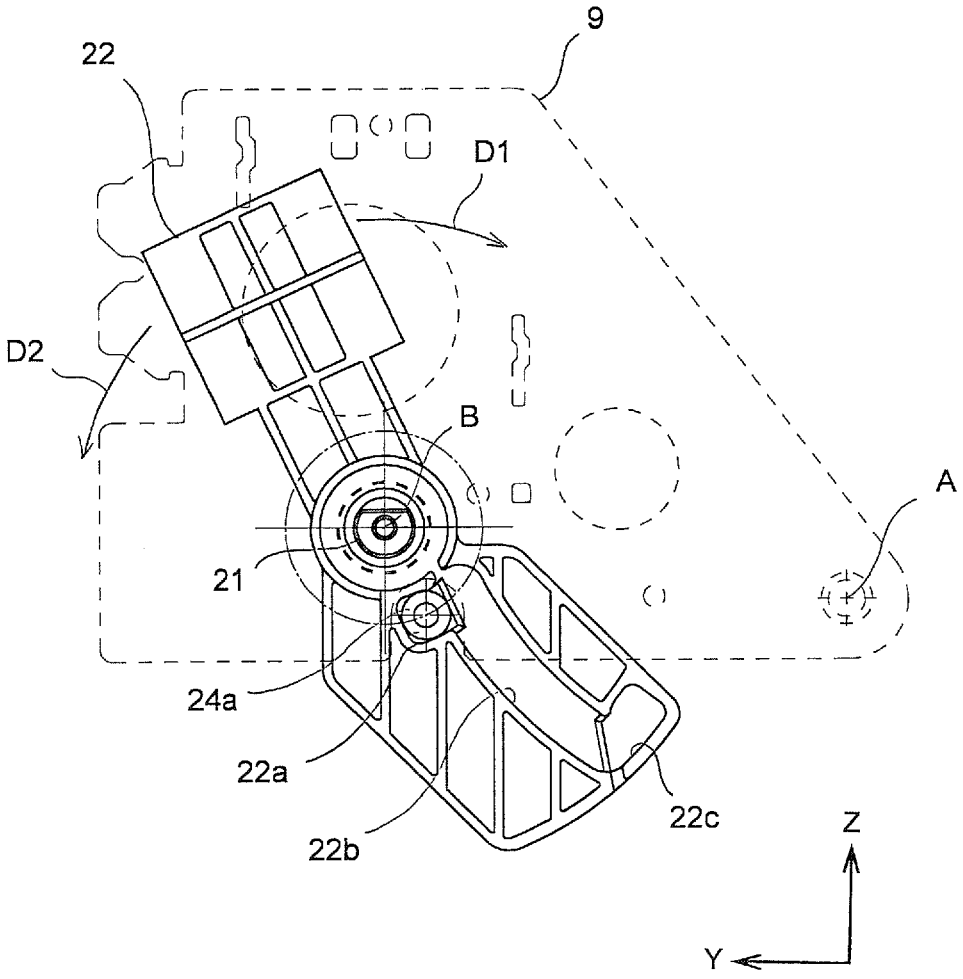
FIG. 6 is a schematic view showing a tilt lever according to the first embodiment in a state where the upper frame unit is in a closing position.

FIG. 6 is a schematic view showing the tilt lever 22 in a state where the upper frame unit 9 is in the closing position as seen from an inner side of the side plate 91 (i.e., as seen from the −X side). The tilt lever 22 has the first groove portion 22*a* (i.e., a first portion) that engages the boss 24*a* of the lower frame unit 8. The first groove portion 22*a* extends along a circular arc about the center axis B of the carriage shaft 21.

When the upper frame unit 9 is in the closing position, the first groove portion 22*a* of the tilt lever 22 engages the boss 24*a* of the lower frame unit 8. When a user is going to rotate the upper frame unit 9 upward about the rotation axis A, an upward rotation of the upper frame unit 9 is prevented by engagement between the first groove portion 22*a* of the tilt lever 22 and the boss 24*a*. In other words, the upper frame unit 9 is locked at the closing position.

Figure 7:
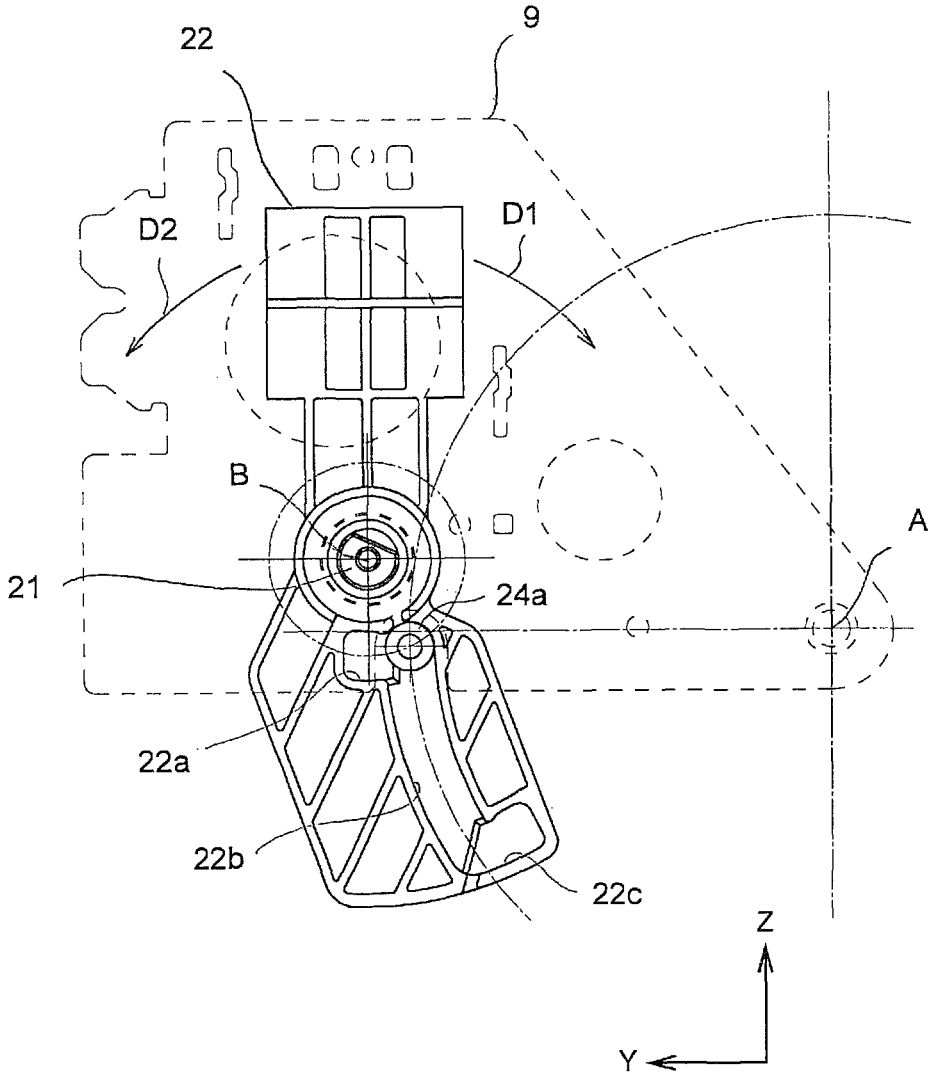
FIG. 7 is a schematic view showing the tilt lever according to the first embodiment in a state where the tilt lever is rotated in a no/mal direction from the state shown in FIG. 6.

FIG. 7 is a schematic view showing the tilt lever 22 in a state where the tilt lever 22 is rotated clockwise by a predetermined angle (for example, 25 degrees) from the state shown in FIG. 6. The tilt lever 22 has the second groove portion 22*b* (i.e., a second portion) extending from a terminal end of the first groove portion 22*a*. The second groove portion 22*b* extends along a circular arc about the rotation axis A.

When the first groove portion 22*a* disengages from the boss 24*a* by the rotation of the tilt lever 22, the locking of the upper frame unit 9 is released, and the upper frame unit 9 becomes rotatable toward the opening position. As the upper frame unit 9 is rotated upward about the rotation axis A, the second groove portion 22*b* of the tilt lever 22 moves along the boss 24*a*.

Figure 8:
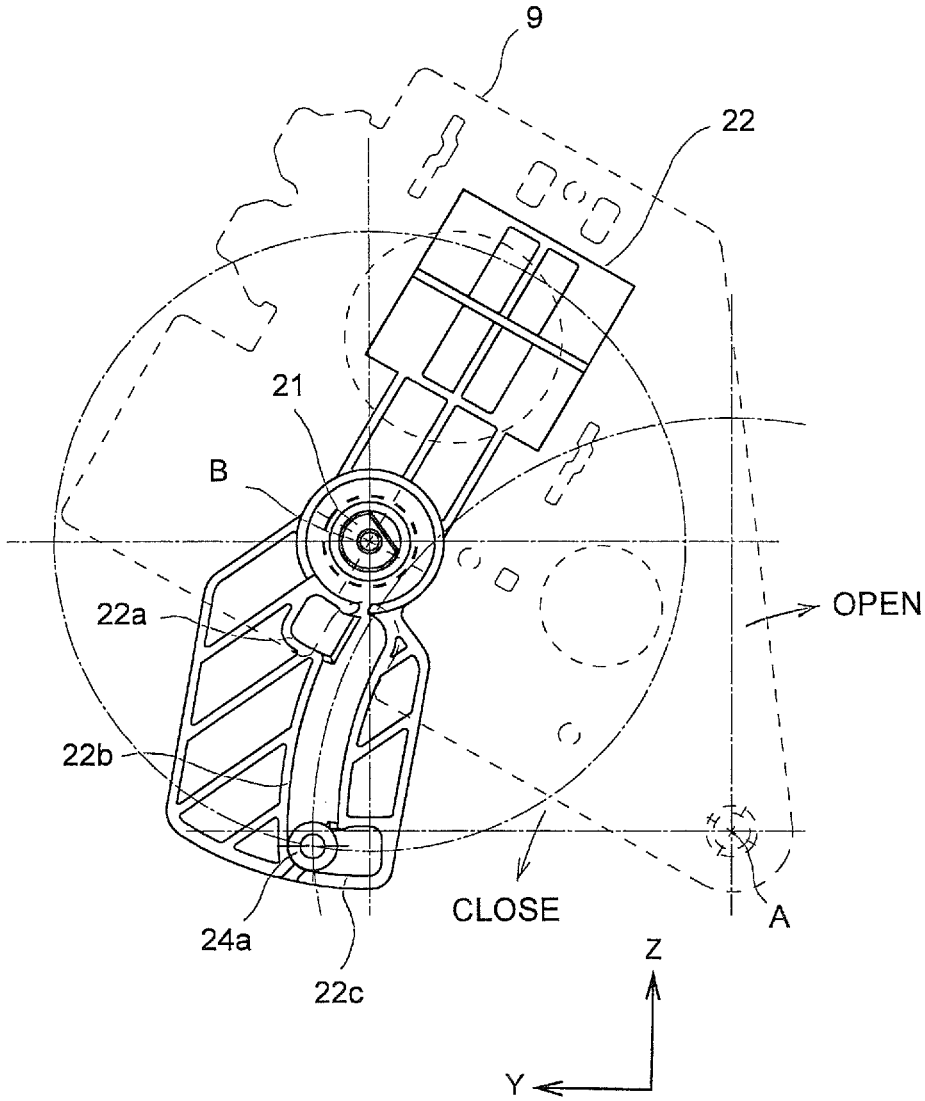
FIG. 8 is a schematic view showing the tilt lever according to the first embodiment in a state where the upper frame unit is rotated to an opening position from the state shown in FIG. 7.

FIG. 8 is a schematic view showing the tilt lever 22 in a state where the upper frame unit 9 is rotated to the opening position. When the upper frame unit 9 is rotated to the opening position, a terminal end (i.e., a lower end) of the second groove portion 22*b* reaches the boss 24*a*.

Figure 9:
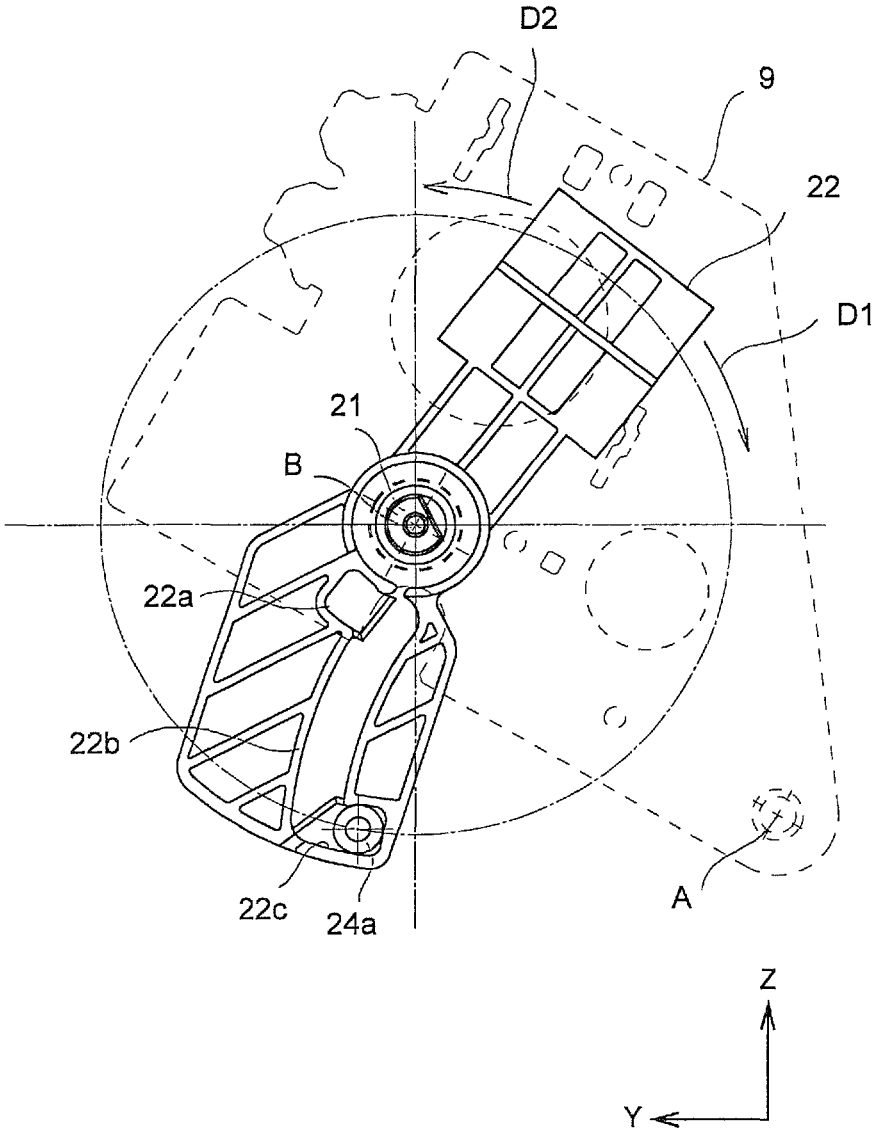
FIG. 9 is a schematic view showing the tilt lever according to the first embodiment in a state where the tilt lever is rotated in the normal direction from the state shown in FIG. 8.

FIG. 9 is a schematic view showing the tilt lever 22 in a state where the tilt lever 22 is rotated clockwise by a predetermined angle (for example, 5 degrees) from the state shown in FIG. 8. The tilt lever 22 has the third groove portion 22*c* (i.e., a third portion) extending from the terminal end (i.e., the lower end) of the second groove portion 22*b*. The third groove portion 22*c* extends along a circular arc about the center axis B of the carriage shaft 21.

When the tilt lever 22 is rotated by a predetermined angle after the upper frame unit 9 reaches the opening position, the third groove portion 22*c* of the tilt lever 22 engages the boss 24*a* of the lower frame unit 8. A downward rotation of the upper frame unit 9 is prevented by engagement between the third groove portion 22*c* of the tilt lever 22 and the boss 24*a*. In other words, the upper frame unit 9 is locked at the opening position.

Here, a clockwise direction of the tilt lever 22 in FIGS. 6 through 9 is referred to as a normal direction (i.e., a D1 direction). A counterclockwise direction of the tilt lever 22 in FIGS. 6 through 9 is referred to as a reverse direction (i.e., a D2 direction).

Next, description will be made of a configuration for preventing the gears from hitting each other when the upper frame unit 9 returns to the closing position.

As described above, the front upper roller 12 and the front lower roller 13 are both mounted to the lower frame unit 8. In contrast, the rear upper roller 14 is mounted to the upper frame unit 9, but the rear lower roller 15 is mounted to the lower frame unit 8. Therefore, it is necessary to prevent the gear 16*c* of the rear upper roller 14 and the gear 16*d* of the rear lower roller 15 from hitting each other. The configuration described below is provided for this purpose.

Figure 10:
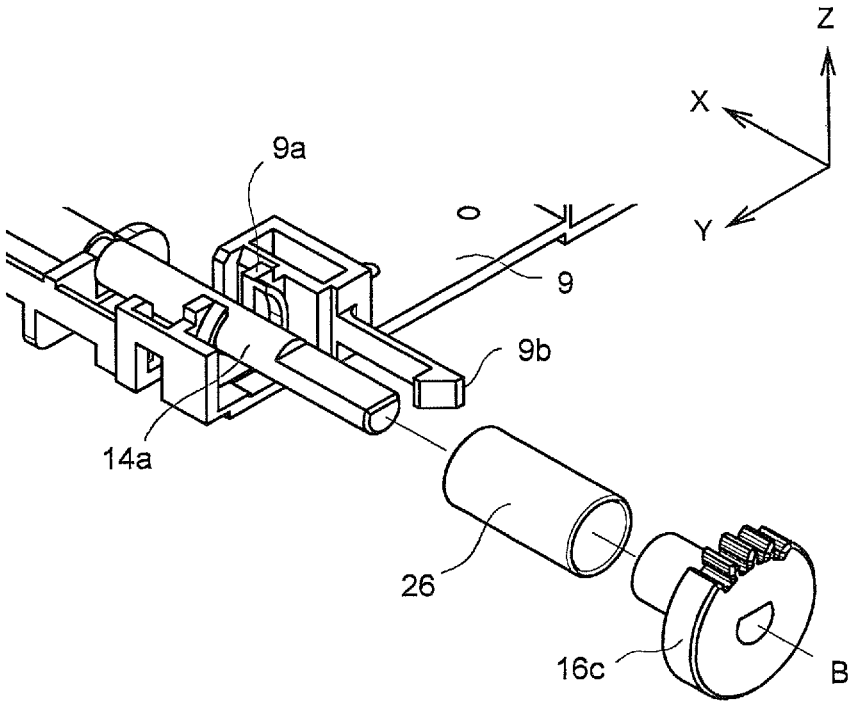
FIG. 10 is an exploded perspective view showing a mounting structure of gears of feeding rollers of the image forming apparatus according to the first embodiment.
Figure 11:
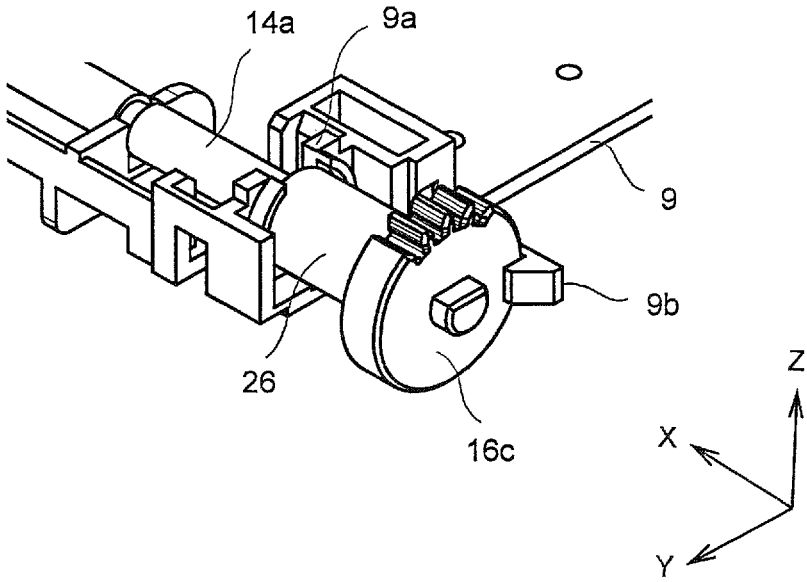
FIG. 11 is a perspective view showing the mounting structure of the gears of the feeding rollers of the image forming apparatus according to the first embodiment.

FIGS. 10 and 11 are an exploded perspective view and a perspective vie showing a mounting structure of the gear 16*c*. The gear 16*c* of the rear upper roller 14 is supported so as to be movable in the X direction. This is because, by allowing the gear 16*c* to move in the X direction, the gears 16*c* and 16*d* can be prevented from hitting each other when the upper frame unit 9 returns to the closing position.

To be more specific, a shaft 14*a* (i.e., the rotation shaft) of the rear upper roller 14 has an end portion (i.e., a gear holding portion) which is formed to have a D-shaped cross section. The gear 16*c* has an engaging hole having a D-shape. The engaging hole of the gear 16*c* engages the end portion (having the D-shaped cross section) of the shaft 14*a* so that the gear 16*c* is slidable in the axial direction of the shaft 14*a*. The end portion (having the D-shaped cross section) of the shaft 14*a* has a sufficient length covering a moving range of the gear 16*c* in the X direction. With such a configuration, the gear 16*c* is movable in the X direction along the shaft 14*a* of the rear upper roller 14, and rotates together with the rear upper roller 14.

A coil spring 26 (i.e., a biasing unit) is provided so as to surround the shaft 14*a* of the rear upper roller 14. The coil spring 26 is configured to bias the gear 16*c* in the −X direction. The coil spring 26 has a winding axis extending in the X direction. An end of the coil spring 26 contacts the shaft 14*a*. The other end of the coil spring 26 contacts a shaft holding portion 9*a* provided on the upper frame unit 9.

Further, the upper frame unit 9 has a stopper 9*b* (FIG. 11) that defines a limit of movement of the gear 16*c* in the −X direction. The stopper 9*b* prevents the gear 16*c* from dropping out of the shaft 14*a* of the rear upper roller 14.

A cam member 25 (FIG. 4) is provided in the vicinity of the end of the carriage shaft 21 in the −X direction. The cam member 25 (i.e., a shift mechanism) is configured to move the gear 16*c* in the X direction in accordance with the rotation (i.e., the opening and closing) of the upper frame unit 9.

Figure 12:
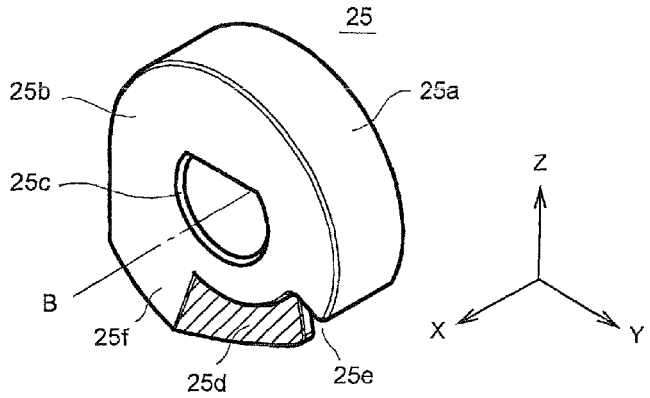
FIG. 12 is a perspective view showing a cam member of the image forming apparatus according to the first embodiment.

FIG. 12 is a perspective view showing the cam member 25. The cam member 25 has a substantially cylindrical shape whose axial direction is parallel to the X direction. To be more specific, the cam member 25 has an outer circumferential surface 25*a* (which is substantially cylindrical) and a circular plate 25*b* provided at an end of the outer circumferential surface 25*a* in the +X direction. An engaging hole 25*c* is provided at a substantially center of the circular plate 25*b*. The engaging hole 25*c* is D-shaped, and engages the end portion (having the D-shaped cross section) of the carriage shaft 21. By engagement between the engaging hole 25*c* and the end portion of the carriage shaft 21, the cam member 25 rotates together with the carriage shaft 21 about the center axis B of the carriage shaft 21.

The cam member 25 rotates together with the carriage shaft 21 (i.e., also together with the tilt lever 22). Therefore, when the tilt lever 22 rotates in the normal direction (D1), the cam member 25 also rotates in the normal direction (D1). When the tilt lever 22 rotates in the reverse direction (D2), the cam member 25 also rotates in the reverse direction (D2).

The cam member 25 has a recess portion 25*e* which is retracted inward in a radial direction from the outer circumferential surface 25*a*, and a protruding portion 25*f* that protrudes outward in the radial direction from the outer circumferential surface 25*a*. A cam surface 25*d* is formed between the recess portion 25*e* and the protruding portion 25*f*. The cam surface 25*d* has an inclination such that, when the cam 25 rotates in the normal direction (D1), a position on the cam surface 25*d* moves in the +X direction.

Figure 13A:
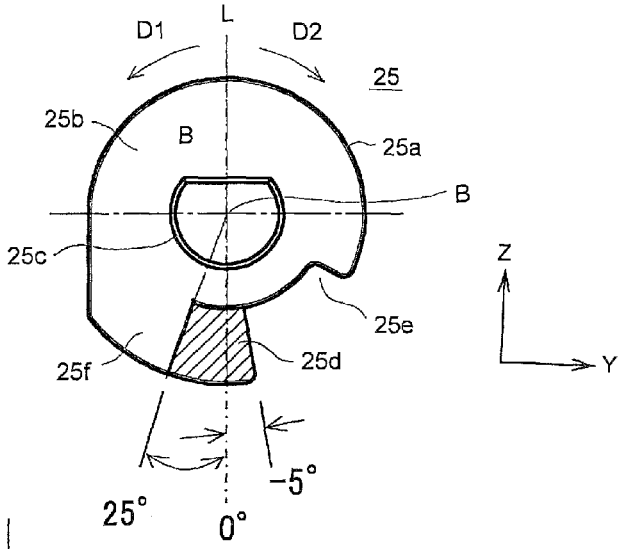
FIG. 13A is a front view showing the cam member of the image forming apparatus according to the first embodiment.
Figure 13B:
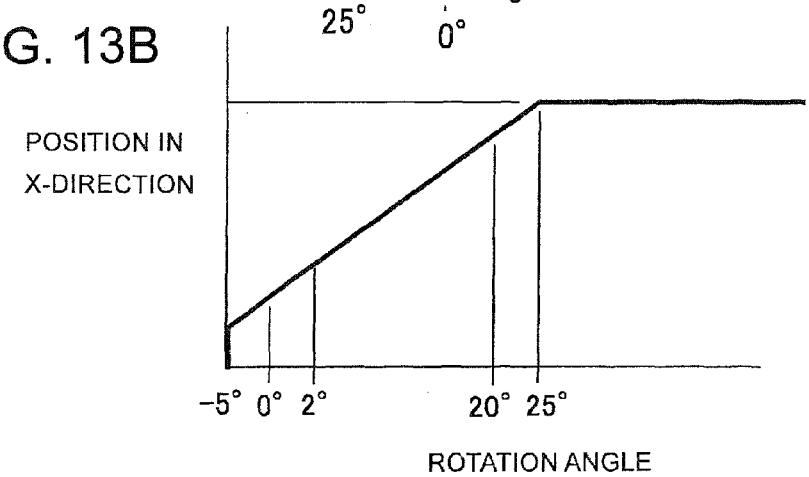
FIG. 13B is a schematic view showing a cam profile of the can member shown in FIG. 13A.

FIG. 13A is a front view showing the cam member 25 as seen from the +X side. FIG. 13B is a schematic view showing a cam profile of the cam surface 25*d*. A rotation angle of the cam member 25 when the tilt lever 22 is in a position shown in FIG. 6 (when the upper frame unit 9 is locked at the closing position) is defined as 0 degree, i.e., a reference angle. Here, a line L is defined as connecting the center axis B and a lowermost point of the cam member 25. In a state where the rotation angle of the cam member 25 is 0 (i.e., the reference angle), the cam surface 25*d* extends from −5 degrees to 25 degrees with respect to the line L.

Figure 14A:
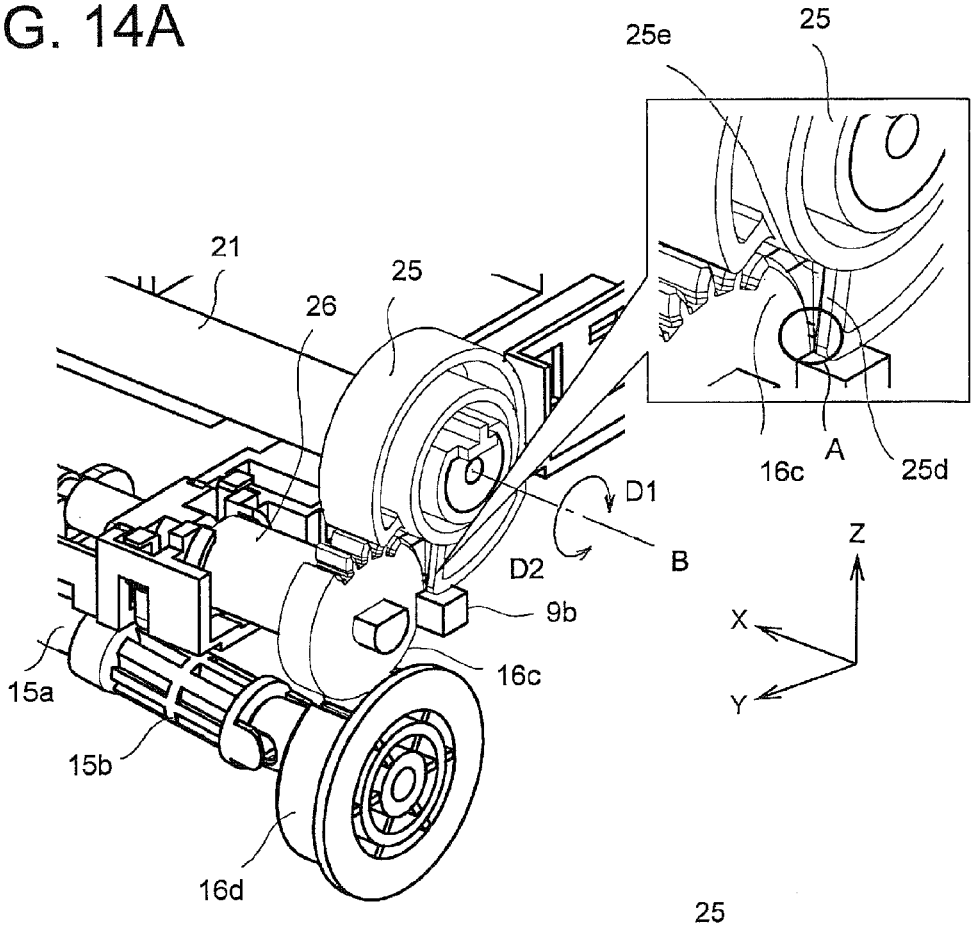
FIGS. 14A and 14B are a perspective view and a plan view showing a relationship among a gear of a rear upper roller, a gear of a rear lower roller and the cam member of the image forming apparatus according to the first embodiment.
Figure 14B:
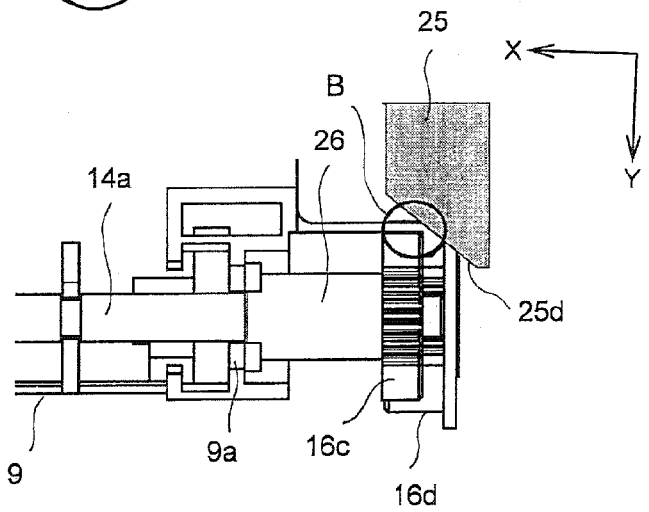

FIG. 14A is a perspective view showing a relationship among the gear 16*c* of the rear upper roller 14, the gear 16*d* of the rear lower roller 15 and the cam member 25. FIG. 14B is a plan view showing a contact portion between the cam member 25 and the gear 16*c* and its surroundings as seen from above (i.e., from the +Z side).

The gear 16*d* of the rear lower roller 15 is mounted to a shaft 15*a* (i.e., the rotation shaft) of the rear lower roller 15 via a universal joint 15*b* (i.e., a connecting member). This is to keep the gears 16*c* and 16*d* meshing with each other when a thick medium 7 is introduced between the rear upper roller 14 and the rear lower roller 15 (i.e., when a gap between the rear rollers 14 and 15 increases).

FIGS. 14A and 14B show state where the upper frame unit 9 is locked at the closing position. The rotation angle of the cam member 25 is 0 degree (i.e., the reference angle) as shown in FIGS. 13A and 13B. When the rotation angle of the cam member 25 is 0 degree, the gear 16*c* is in the recess portion 25*e* of the cam member 25, and faces the cam surface 25*d*. In this state, the gear 16*c* contacts the stopper 9*b*, but does not contact the cam surface 25*d* as shown by circles A and B in FIGS. 14A and 14B.

Figure 15A:
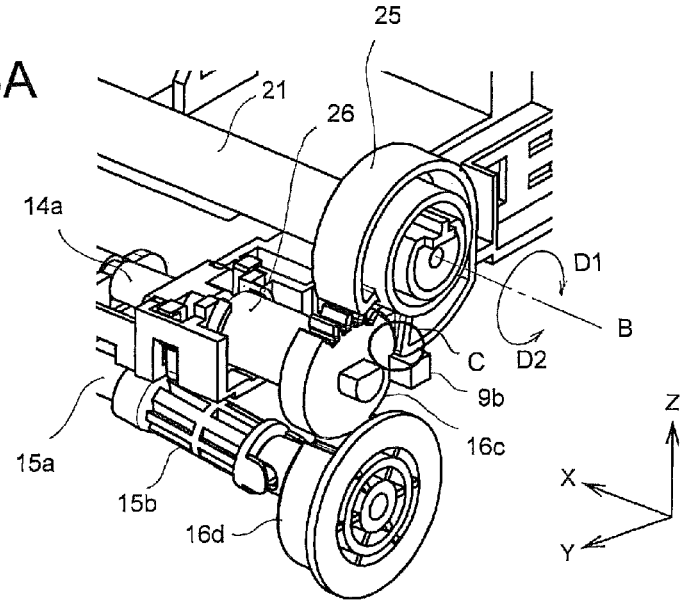
FIGS. 15A and 15B are a perspective view and a plan view showing a state where the cam member is rotated in the normal direction from the state shown in FIGS. 14A and 14B.
Figure 15B:
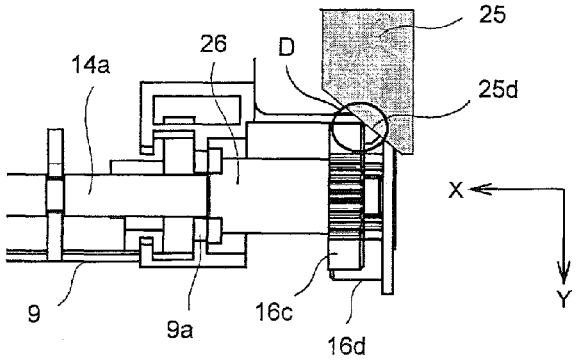

FIG. 15A is a perspective view showing a state where the cam member 25 rotates in the normal direction (D1) from the state shown in FIG. 14A. FIG. 15B is a plan view showing the contact portion between the cam member 25 and the gear 16*c* and its surroundings as seen from above (i.e., from the +Z side). When the cam member 25 rotates by 2 degrees in the normal direction (D1) from the reference angle, the cam surface 25*d* of the cam member 25 contacts the gear 16*c* as shown by circles C and D in FIGS. 15A and 15B.

When the cam member 25 further rotates in the normal direction (D1), the cam surface 25*d* of the cam member 25 pushes gear 16*c* in the +X direction. Therefore, the gear 16*c* moves in the +X direction resisting the biasing force of the coil spring 26.

Figure 16A:
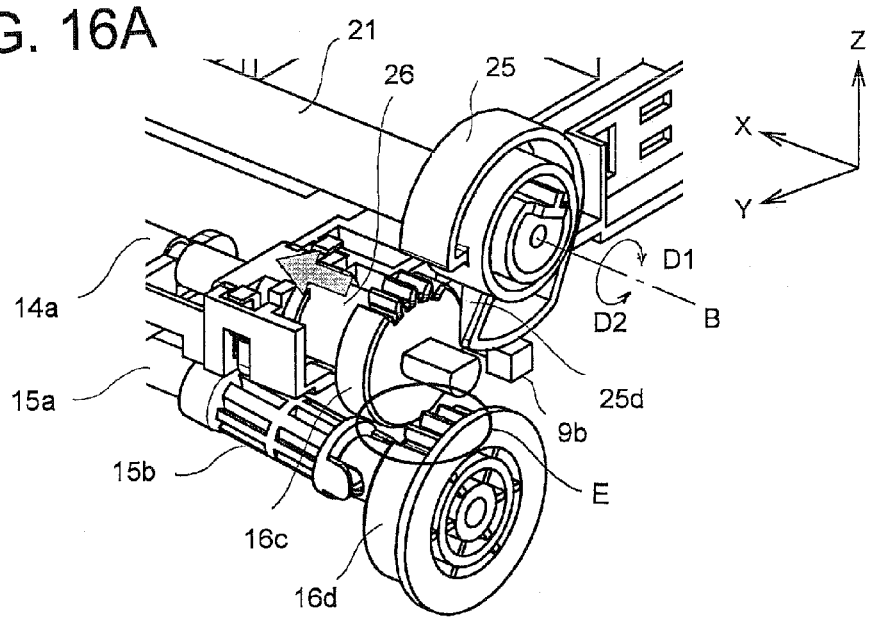
FIGS. 16A, 16B and 16C are a perspective view, a plan view and a front view showing a state where the cam member is rotated in the normal direction from the state shown in FIGS. 15A and 15B.
Figure 16B:
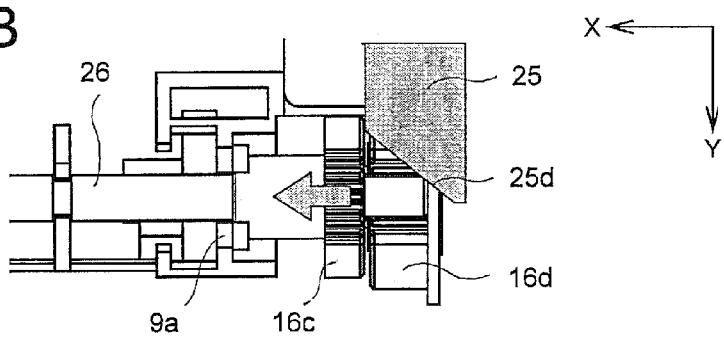
Figure 16C:
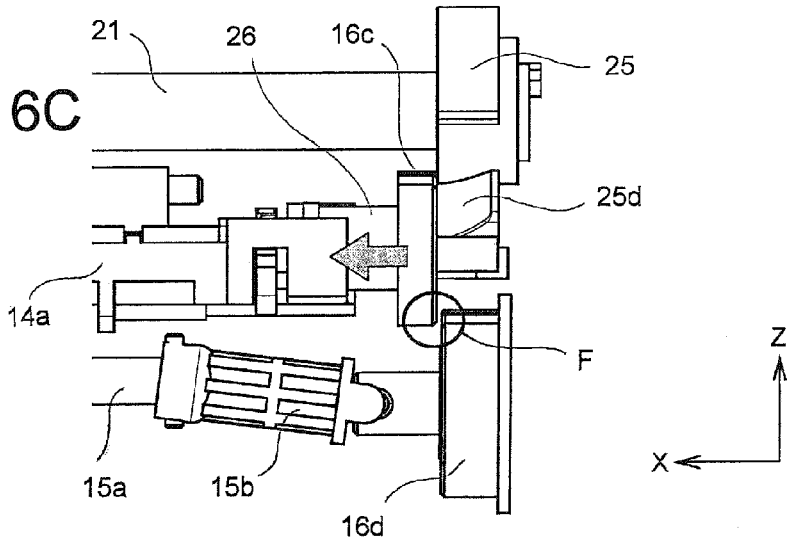

FIG. 16A is a perspective view showing a state where the cam member 25 further rotates in the normal direction (D1). FIG. 16B is a plan view showing the contact portion between the cam member 25 and the gear 16*c* and its surroundings as seen from above (i.e., from the +Z side). FIG. 16C is a front view showing the contact portion between the cam member 25 and the gear 16*c* and its surroundings as seen from front (i.e., from the +Y side). When the rotation angle of the cam member 25 (from the reference angle) reaches 20 degrees, the gear 16*c* pushed by the cam surface 25*d* of the cam member 25 is released from meshing with the gear 16*d*. When the rotation angle of the cam member 25 reaches 25 degrees, the meshing between the gears 16*c* and 16*d* is completely released as shown by circles E and F in FIGS. 16A and 16C. In other words, the gears 16*c* and 16*d* are apart from each other.

In this regard, when the rotation angle of the cam member 25 reaches 25 degrees, the first groove portion 22*a* of the tilt lever 22 disengages from the boss 24*a* as shown in FIG. 7, and the engaging groove 23*a* (FIG. 5B) of the lock lever 23 disengages from the boss 24*b*. In other words, the locking, of the upper frame unit 9 at the closing position is released. Accordingly, in a state where the locking of the upper frame unit 9 at the closing position is released, it is ensured that the meshing between the gears 16*c* and 16*d* is released.

Thereafter, when the upper frame unit 9 is rotated from the closing position toward the opening position, the tilt lever 22 is not operated (rotated), and therefore a rotational position of the cam member 25 about the center axis B does not change. Accordingly, the gear 16*c* is kept displaced from the gear 16*d* in the +X direction.

Further, after the upper frame unit 9 reaches the opening position, when the tilt lever 22 is rotated (operated) in the normal direction (D1) as shown in FIG. 9 in order to lock the upper frame unit 9 at the opening position, the cam member 25 rotates. During this rotation of the cam member 25, the contact portion between the cam member 25 and the gear 16*c* moves from a terminal end of the cam surface 25*d* to a flat surface of the protruding portion 25*f* (FIG. 13), and therefore a position of the gear 16*c* does not change. Accordingly, the gear 16 is held at a position displaced from the gear 16*d* in the +X direction.

Further, when the upper frame unit 9 rotates from the opening position to the closing position, the tilt lever 22 is not operated (rotated), and therefore the rotational position of the cam member 25 about the center axis B does not change. Accordingly, the gear 16*c* is held at the position displaced from the gear 16*d* in the +X direction.

Therefore, when the upper frame unit 9 reaches to the closing position, the gear 16*c* of the upper frame unit 9 is kept displaced from the gear 16*d* of the lower frame unit 8 in the +X direction. Thus, the gears 16*c* and 16*d* are prevented from hitting each other.

Thereafter, when the tilt lever 22 is rotated (operated) in the reverse direction (D2) in order to lock the upper frame unit 9 at the closing position, the cam member 25 rotates in the reverse direction (D2) as shown in FIG. 15A. When the cam member 25 rotates in the reverse direction (D2), the contact portion between the cam surface 25*d* and the gear 16*c* moves in the −X direction, and the gear 16*c* moves in the −X direction by the biasing force of the coil spring 26.

When the rotation angle of the cam member 25 (from the reference angle) returns to 20 degrees, the gears 16*c* and 16*d* start meshing with each other. When the rotation angle of the cam member 25 (from the reference angle) returns to 2 degrees, the gear 16*c* contacts the stopper 9*b*. In this state, the gears 16*c* and 16*d* completely mesh with each other. When the rotation angle of the cam member 25 returns to the reference angle (0 degree), the cam member 25 separates from the gear 16*c* by a predetermined distance.

<Operation of Image Forming Apparatus>

An operation (i.e., a printing operation) of the image forming apparatus 100 will be described.

In FIG. 1, the user inserts the medium 7 such as a printing sheet through the medium insertion opening 6 along the stage 5. When the inserted medium 7 is detected by a medium sensor (not shown) provided at a rear side of the medium insertion opening 6, the feeding motor 18 starts rotating. A rotation of the feeding motor 18 is transferred to the gears 16*a*, 16*b*, 16*c* and 16*d* shown in FIGS. 3 and 4, and the front rollers 12 and 13 and the rear rollers 14 and 15 start rotating. The front rollers 12 and 13 and the rear rollers 14 and 15 feed the medium 7 in the −Y direction (i.e., rearward).

At a timing when a leading edge of the medium 7 passes the platen 19, the carriage driving motor 27 (FIG. 3) starts rotating, and moves the carriage unit 11 (FIG. 4) in the X direction. While the carriage unit 11 moves in the X direction, the wire protrudes from the head nose of the print head 10 and impacts the platen 19. The ink ribbon is transferred to the medium 7 by impact. In this way, a line image (i.e., a one-dimensional image) in the X direction is formed on the medium 7.

The front rollers 12 and 13 and the rear rollers 14 and 15 feed the medium 7 in the Y direction while the print head 10 forms the line images in the X direction. As a result, a two-dimensional image is formed on the medium 7.

When a predetermined time elapses after a trailing edge of the medium 7 passes the medium sensor (i.e., when the trailing edge of the medium 7 passes the platen 19), the carriage unit 11 moves to the standby position. Then, the front rollers 12 and 13 and the rear rollers 14 and 15 feed the medium 7 in the +Y direction, and eject the medium 7 from the medium insertion opening 6. With this, the printing operation on the medium 7 is completed.

<Operation when Medium Jam Occurs>

During the above described printing operation, a jam of the medium 7 may occur. If such a jam occurs, the user first detaches the upper cover 1 (FIG. 1) from the image forming apparatus 100. When the upper cover 1 is detached, the tilt lever 22 is exposed, and it becomes possible to rotate (operate) the tilt lever 22.

Next, the user rotates the tilt lever 22 in the normal direction (D1) about the center axis B of the carriage shaft 21 by pushing the tilt lever 22 in the −Y direction (rearward). As the tilt lever 22 rotates in the normal direction (D1), the first groove portion 22*a* (having a circular arc shape about the center axis B) of the tilt lever 22 moves along the boss 24*a* of the lower frame unit 8, and then the second groove portion 22*b* of the tilt lever 22 engages the boss 24*a*.

The lock lever 23 (FIG. 5B) rotates about the center axis B of the carriage shaft 21 in conjunction with the rotation of the tilt lever 22. The engaging groove 23*a* of the lock lever 23 disengages from the boss 24*b* substantially at the same time as when the first groove portion 22*a* of the tilt lever 22 disengages from the boss 24*a*. As a result, the locking of the upper frame unit 9 at the closing position is released.

When the locking of the upper frame unit 9 at the closing position is released, the meshing between the gears 16*c* and 16*d* is switched as described below.

First, when the tilt lever 22 rotates in the normal direction (D1), the carriage shaft 21 also rotates about the center axis B. Therefore, the cam member 25 mounted to the carriage shaft 21 also rotates in the normal direction (D1) about the center axis B.

When the cam member 25 rotates in the normal direction (D1) by 2 degrees from the reference angle (i.e., 0 degree shown in FIG. 13B), the cam surface 25*d* of the cam member 25 contacts the gear 16*c* of the rear upper roller 14. When the cam member 25 further rotates in the normal direction (D1), the cam surface 25*d* of the cam member 25 pushes the gear 16*c* in the +X direction. Therefore, the gear 16*c* moves in the +X direction resisting the biasing force of the coil spring 26.

When the rotation angle of the cam member 25 (from the reference angle) reaches 20 degrees, the meshing between the gears 16*c* and 16*d* starts being released. When the rotation angle of the cam member 25 reaches 25 degrees, the meshing between the gears 16*c* and 16*d* is completely released as shown in FIGS. 16A through 16C.

In this way, the meshing between the gears 16*c* and 16*d* is released substantially at the same time as when the locking of the upper frame unit 9 at the closing position is released.

Thereafter, the user rotates the upper frame unit 9 upward about the rotation axis A as shown in FIG. 7. In this state, the second groove portion 22*b* of the tilt lever 22 moves along the boss 24*a* of the lower frame unit 8. Then, when the upper frame unit 9 is further rotated upward, the lower end of the second groove portion 22*b* reaches the boss 24*a*.

Then, when the lower end of the second groove portion 22*b* of the tilt lever 22 reaches the boss 24*a* as shown in FIG. 8, the upper frame unit 9 is prevented from further rotating upward. In this state, the user rotates the tilt lever 22 in the normal direction (D1) about the center axis B of the carriage shaft 21.

When the tilt lever 22 is rotated in the normal direction (D1) about the center axis B by 5 degrees, the third groove portion 22*c* of the tilt lever 22 engages the boss 24*a* of the lower frame unit 8. Therefore, the rotation of the upper frame unit 9 is locked, and the upper frame unit 9 is held at the opening position. In this state, the tilt lever 22 functions as a stay for supporting the upper frame unit 9 at the opening position.

In a state where the upper frame unit 9 is held at the opening position, the rear upper roller 14 and the rear lower roller 15 are separated from each other, and the carriage unit 11 and the platen 19 are separated from each other. Therefore, the user can easily remove the jammed medium 7 from between the rear upper roller 14 and the rear lower roller 15, or from between the carriage unit 11 and the platen 19.

When removal of the jammed medium 7 is completed, the user rotates the upper frame unit 9 from the opening position to the closing position.

To be more specific, the user rotates the tilt lever 22 in the reverse direction (D2) about the center axis B of the carriage shaft 21 from the state shown in FIG. 9. As the tilt lever 22 rotates in the reverse direction (D2), the third groove portion 22*c* of the tilt lever 22 disengages from the boss 24*a* of the lower frame unit 8, and the second groove portion 22*b* of the tilt lever 22 engages the boss 24*a* of the lower frame unit 8. Therefore, the locking of the upper frame unit 9 at the opening position is released.

Then, the user rotates the upper frame unit 9 downward about the rotation axis A. As the upper frame unit 9 rotates downward as shown in FIG. 8, the second groove portion 22*b* of the tilt lever 22 moves along the boss 24*a* of the lower frame unit 8.

When the upper frame unit 9 reaches the closing position, the upper end of the second groove portion 22*b* of the tilt lever 22 reaches the boss 24*a* of the lower frame unit 8 as shown in FIG. 7.

When the upper frame unit 9 returns to the closing position, the gear 16*c* is in a position displaced from the gear 16*d* in the +X direction as described above. Therefore, tooth tips of the gear 16*c* mounted to the upper frame unit 9 and the tooth tips of the gear 16*d* mounted to the lower frame unit 8 do not hit each other. Accordingly, the gears 16*c* and 16*d* are prevented from being damaged.

Then, the user rotates the tilt lever 22 in the reverse direction (D2). When the tilt lever 22 rotates in the reverse direction (D2), the first groove portion 22*a* of the tilt lever 22 engages the boss 24*a* of the lower frame unit 8.

The lock lever 23 rotates about the center axis B of the carriage shaft 21 in conjunction with the tilt lever 22. The engaging groove 23*a* of the lock lever 23 engages the boss 24*b* of the lower frame unit 8 substantially at the same time as when the first groove portion 22*a* of the tilt lever 22 engages the boss 24*a*. Therefore, the upper frame unit 9 is locked at the closing position.

When the upper frame unit 9 is locked at the closing position, the meshing between the gears 16*c* and 16*d* is switched as described below.

When the tilt lever 22 rotates in the reverse direction (D2), the cam member 25 also rotates in the reverse direction (D2) about the center axis B. When the cam member 25 rotates in the reverse direction (D2) about the center axis B, the contact portion between the cam surface 25*d* and the gear 16*c* moves in the −X direction, and therefore the gear 16*c* moves in the −X direction by the biasing force of the coil spring 26.

When the rotation angle of the cam member 25 (from the reference angle) returns to 20 degrees, the gears 16*c* and 16*d* start meshing with each other. When the rotation angle of the cam member 25 (from the reference angle) returns to 2 degrees, the gears 16*c* and 16*d* completely mesh with each other. When the rotation angle of the cam member 25 returns to the reference angle (0 degree), the cam surface 25*d* of the cam member 25 separates from the gear 16*c* by the predetermined distance.

Since the gear 16*c* and 16*d* mesh with each other, the driving force of the feeding motor 18 becomes transmittable to the gears 16*a*, 16*b*, 16*c* and 16*d*. Therefore, the feeding of the medium 7 by the front rollers 12 and 13 and the rear rollers 14 and 15 and the printing on the medium 7 are enabled.

The above described operation is also performed when the upper frame unit 9 is opened and closed for replacing (i.e., detaching and attaching) the ink ribbon cassette.

Advantages of First Embodiment

As described above, according to the first embodiment, when the upper frame unit 9 is moved to the closing position with respect to the lower frame unit 8, the cam member 25 (i.e., the shift mechanism) holds the gear 16*c* at a position (i.e., a retracted position) where the gear 16*c* does not mesh with the gear 16*d*. Therefore, the gears 16*c* and 16*d* are prevented from hitting each other. As a result, the gears 16*c* and 16*d* are prevented from being damaged.

Further, the cam member 25 moves the gear 16*c* to the retracted position in conjunction with an operation of the tilt lever 22 to release the locking of the upper frame unit 9. Therefore, it is not necessary for the user to separately perform an operation to move the gear 16*c* to the retracted position.

Furthermore, the cam member 25 moves the gear 16*c* to a meshing position where the gear 16*c* meshes with the gear 16*d*, in conjunction with an operation of the tilt lever 22 to lock the upper frame unit 9 at the closing position. Therefore, the printing operation can be started immediately after the upper frame unit 9 returns to the closing position.

Moreover, the cam member 25 moves the gear 16*c* in the axial direction (i.e., the X direction), and therefore switching of the meshing between the gears 16*c* and 16*d* can be performed with a relatively simple configuration.

Additionally, the tilt lever 22 is rotatably mounted to the upper frame unit 9 and has groove portions 22*a*, 22*b* and 22*c* that engage the boss 24*a* of the lower frame unit 8. Therefore, the rotation of the upper frame unit 9 can be controlled using the tilt lever 22.

Further, the tilt lever 22 functions as a stay for supporting the upper frame unit 9 at the opening position, and therefore it is not necessary to provide an exclusive supporting member for supporting the upper frame unit 9 at the opening position.

Furthermore, the cam member 25 is mounted to the carriage shaft 21 guiding the carriage unit 11, and therefore a locking-and-releasing operation of the upper frame unit 9 using the tilt lever 22 and a moving operation of the gear 16*c* using the cam member 25 can be performed in conjunction with each other.

Second Embodiment

Next, the second embodiment of the present invention will be described. In the second embodiment, the cam member 25 and the lock lever 23 described in the first embodiment are integrated. An image forming apparatus of the second embodiment have the same configurations as those of the image forming apparatus of the first embodiment except the integration of the lock lever 23 and the cam member 25.

Figure 17:
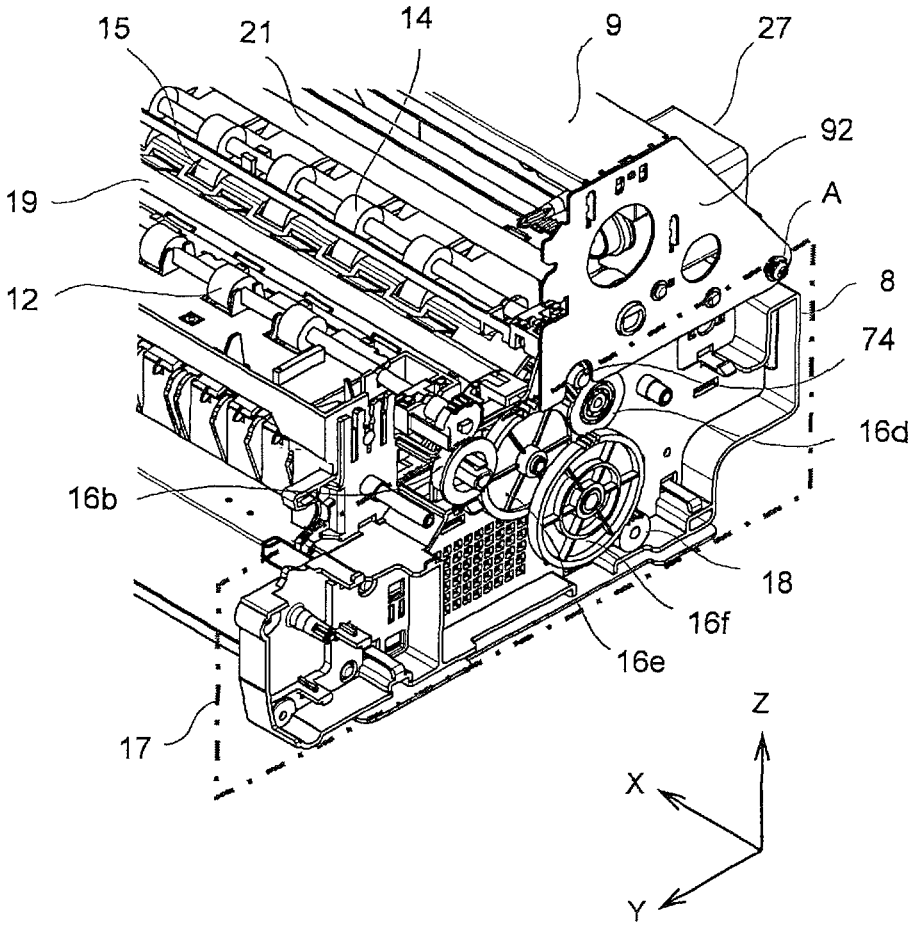
FIG. 17 is an enlarged perspective view showing a main part of an image forming apparatus according to the second embodiment of the present invention.

FIG. 17 is a perspective view showing a main part of the image forming apparatus of the second embodiment. As shown in FIG. 17, the lock lever 23 described in the first embodiment is not provided on the outer side of the side plate 92 of the upper frame unit 9.

Figure 18:
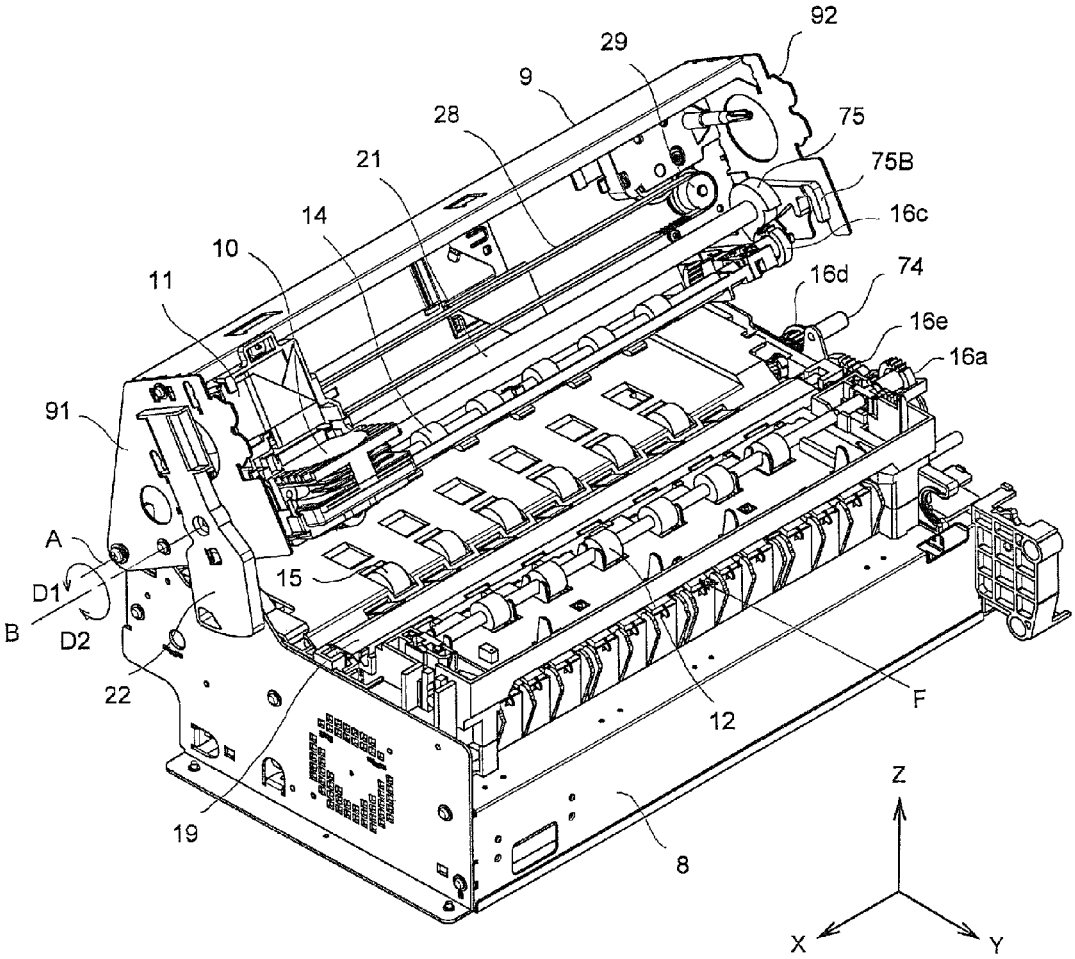
FIG. 18 is a perspective view showing the image forming apparatus according to the second embodiment in a state where an upper frame unit is opened.

FIG. 18 is a perspective view showing the image forming apparatus in a state where the upper frame unit 9 is opened. A combined cam member that also serves as a lock lever (referred to as a cam member 75) is provided in the upper frame unit 9. The cam member 75 is configured to function as the cam member 25 and the lock lever 23 described in the first embodiment.

Figure 19:
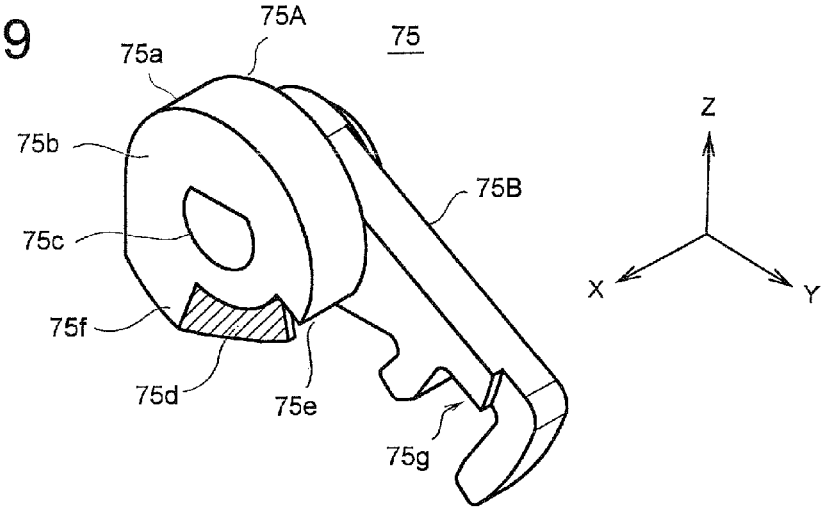
FIG. 19 is a perspective view showing a cam member of the image forming apparatus according to the second embodiment.
Figure 20A:
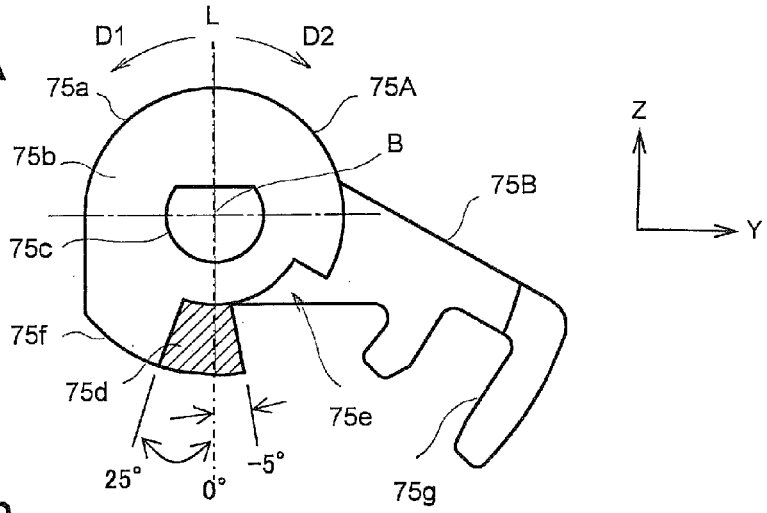
FIG. 20A is a front view showing the cam member of the image forming apparatus according to the second embodiment.
Figure 20B:
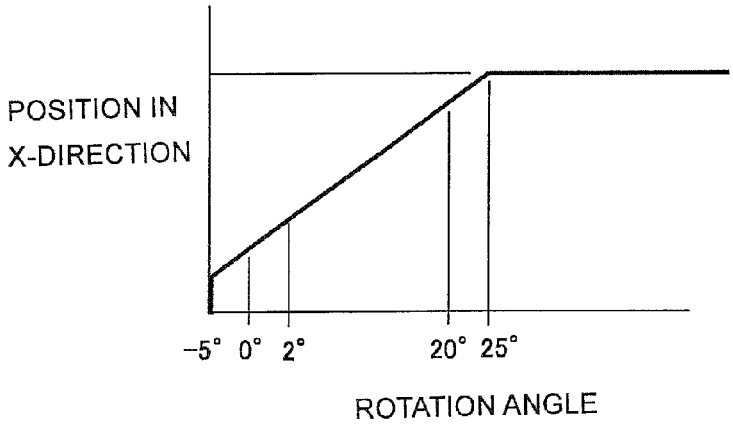
FIG. 20B is a schematic view showing a cam profile of the cam member shown in FIG. 20A.

FIG. 19 is a perspective view showing a shape of the cam member 75. FIG. 20A is a front view showing the cam member 75. FIG. 20B is a schematic view showing a cam profile of the cam member 75. As shown in FIG. 19, the cam member 75 includes a cylindrical portion 75A having a substantially cylindrical shape whose axial direction is parallel to the X direction, and a lock lever portion 75B that protrudes outward (substantially in a radial direction) from the cylindrical portion 75A. The cylindrical portion 75A has an outer circumferential surface 75*a* which is substantially cylindrical, and a circular plate 75*b* provided at an end of the outer circumferential surface 75*a* in the +X direction. An engaging hole 75*c* is provided at a substantially center of the circular plate 75*b*. The engaging hole 75*c* is D-shaped, and engages the end portion (having the D-shaped cross section) of the carriage shaft 21. By engagement between the engaging hole 75*c* and the end portion of the carriage shaft 21, the cam member 75 rotates together with the carriage shaft 21 about the center axis B of the carriage shaft 21.

The lock lever portion 75B (i.e., a lock portion) extends in the radial direction of the cam member 75 from the center axis B (i.e., a rotation axis of the cam member 75). An engaging groove 75*g* is formed on an end portion of the lock lever portion 75B. The engaging groove 75*g* extends along a circular arc about the center axis B.

The engaging groove 75*g* of the lock lever portion 75B engages a boss 74 provided on the lower frame unit 8 shown in FIG. 18 when the upper frame unit 9 is in the closing position. That is, the engaging groove 75*g* engages the boss 74 to lock the upper frame unit 9 in the closing position.

The cam member 75 has a recess portion 75*e* which is retracted inward in a radial direction from the outer circumferential surface 75*a*, and a protruding portion 75*f* that protrudes outward in the radial direction from the outer circumferential surface 75*a*. A cam surface 75*d* is formed between the recess portion 75*e* and the protruding portion 75*f*. The recess portion 75*e*, the protruding portion 75*f* and the cam surface 75*d* are respectively the same as the recess portion 25*e*, the protruding portion 25*f* and the cam surface 25*d* described in the first embodiment.

The cam profile of the cam surface 75*d* shown in FIG. 20B is the same as the cam profile (FIG. 13B) of the cam surface 25*d* described in the first embodiment. That is, when the cam member 75 rotates in the normal direction (D1) from the reference angle (0 degree) by 2 degrees, the cam surface 75*d* of the cam member 75 contacts the gear 16*c*. When the rotation angle of the cam member (from the reference angle) reaches 20 degrees, the gear 16*c* pushed by the cam surface 75*d* of the cam member 75 is released from meshing with the gear 16*d*. When the rotation angle of the cam member 75 (from the reference angle) reaches 25 degrees, the meshing between the gears 16*c* and 16*d* is completely released. That is, the gears 16*c* and 16*d* are apart from each other.

Figure 21A:
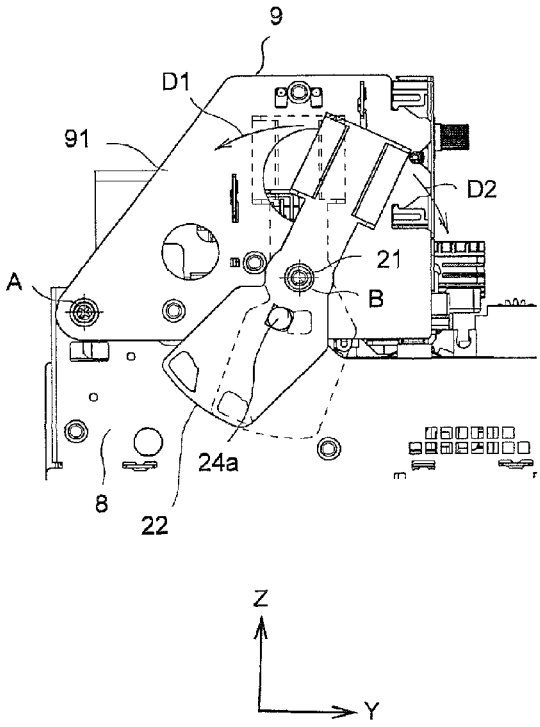
FIG. 21A is a side view showing the upper frame unit of the image forming apparatus according to the second embodiment.
Figure 21B:
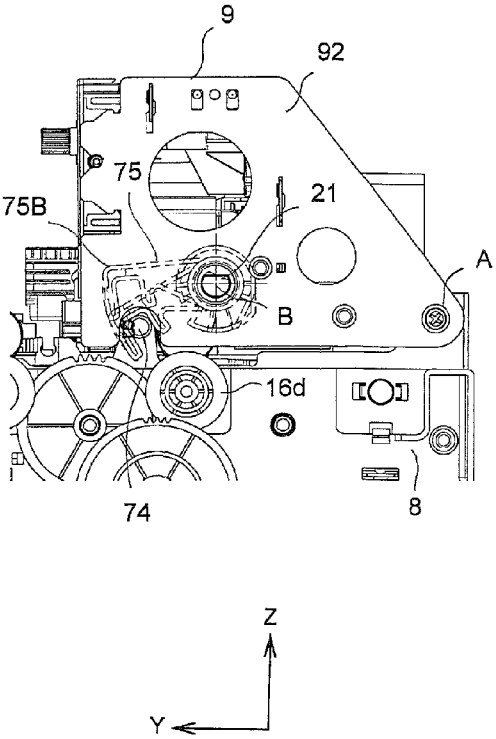
FIG. 21B is a side view showing the upper frame unit of the image forming apparatus according to the second embodiment as seen in the opposite direction to FIG. 21A.

FIG. 21A is a side view showing the upper frame unit 9 as seen from the +X side. FIG. 21B is a side view showing the upper frame unit 9 as seen from the −X side. As described in the first embodiment, when the tilt lever 22 is in a rotational position as shown by a solid line in FIG. 21A, the tilt lever 22 locks the upper frame unit 9 at the closing position. When the tilt lever 22 is in a rotational position as shown by a dashed line in FIG. 21A, the tilt lever 22 releases locking of the upper frame unit 9.

When the lock lever portion 75B of the cam member 75 is in a lower position in FIG. 21B, the engaging groove 75*a* engages the boss 74 and locks the upper frame unit 9 at the closing position. When the lock lever portion 75B of the cam member 75 is in an upper position in FIG. 21B, the engaging groove 75*a* disengages from the boss 74 and releases locking of the upper frame unit 9.

In this regard, the boss 74 of the second embodiment is located at a position shifted in the +Y direction and in the +Z direction with respect to the boss 24*b* (FIG. 5) of the first embodiment. This is because the lock lever portion 75B of the second embodiment is provided on an inner side of the side plate 92 of the upper frame unit 9. The boss 74 is located so that the lock lever portion 75B (engageable with the boss 74) does not interfere with the gear 16*c*.

Figure 22A:
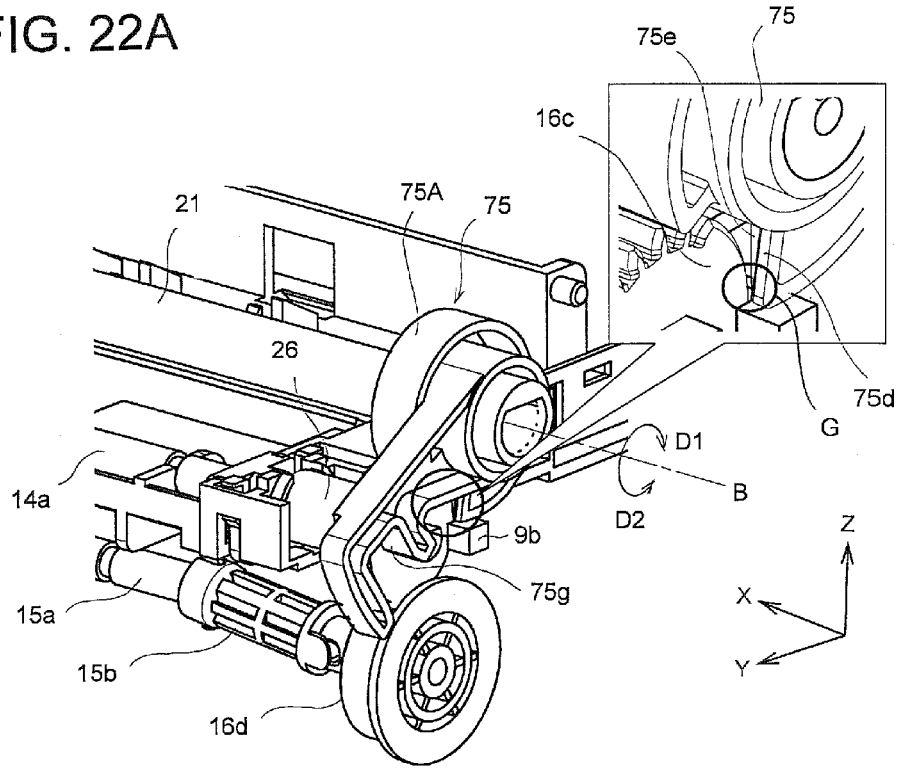
FIGS. 22A and 22B are a perspective view and a plan view showing a relationship among a gear of a rear upper roller, a gear of a rear lower roller and the cam member of the image forming apparatus according to the second embodiment.
Figure 22B:
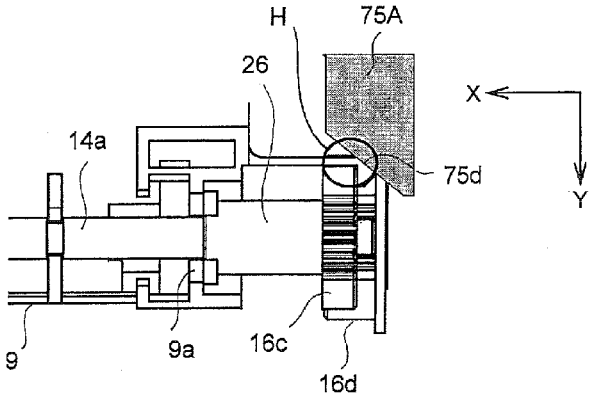

FIG. 22A is a perspective view showing a relationship among the gear 16*c* of the rear upper roller 14, the gear 16*d* of the rear lower roller 15 and the cam member 75 when the upper frame unit 9 is locked at the closing position. FIG. 22B is a plan view showing a contact portion between the cam member 75 and the gear 16*c* and its surroundings as seen from above (i.e., from the +Z side).

In a state shown in FIGS. 22A and 22B, the rotation angle of the cam member 75 is 0 degree (i.e., the reference angle) as described with reference to FIGS. 20A and 20B. When the rotation angle of the cam member 75 is 0 degree, the gear 16*c* is in the recess portion 75*e* of the cam member 75, and faces the cam surface 75*d*. In this state, the gear 16*c* does not contact the cam surface 75*d* as shown by circles G and H in FIGS. 22A and 22B.

The locking of the upper frame unit 9 at the closing position is released as described in the first embodiment. The meshing between the gears 16*c* and 16*d* is switched as described below.

Figure 23A:
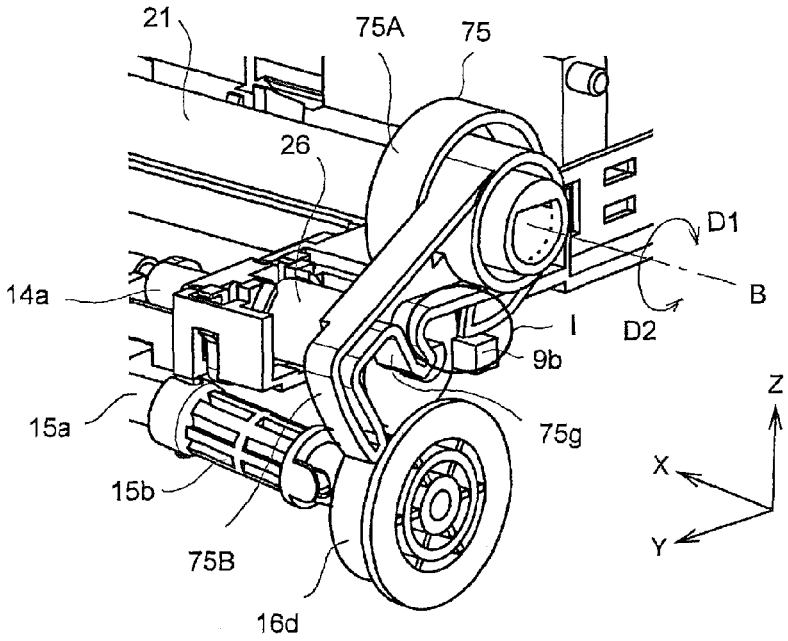
FIGS. 23A and 23B are a perspective view and a plan view showing a state where the cam member is rotated in the normal direction from the state shown in FIGS. 22A and 22B.
Figure 23B:
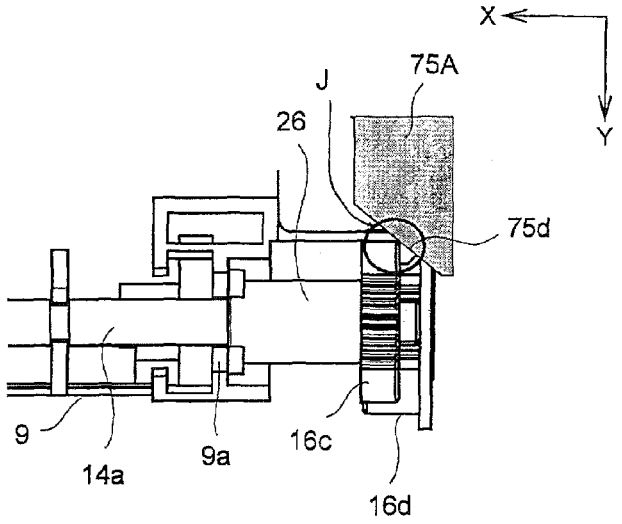

FIG. 23A is a perspective view showing a state where the cam member 75 rotates in the normal direction (D1) from the state shown in FIG. 22A. FIG. 23B is a plan view showing the contact portion between the cam member 75 and the gear 16*c* and its surroundings as seen from above (i.e., from the +Z side). When the cam member 75 rotates in the normal direction (D1) by 2 degrees from the reference angle, the cam surface 75*d* of the cam member 75 contacts the gear 16*c* as shown by circles I and J in FIGS. 23A and 23B.

When the cam member 75 further rotates in the normal direction (D1), the cam surface 75*d* pushes the gear 16*c* in the +X direction. Therefore, the gear 16*c* moves in the +X direction resisting the biasing force of the spring 26.

Figure 24A:
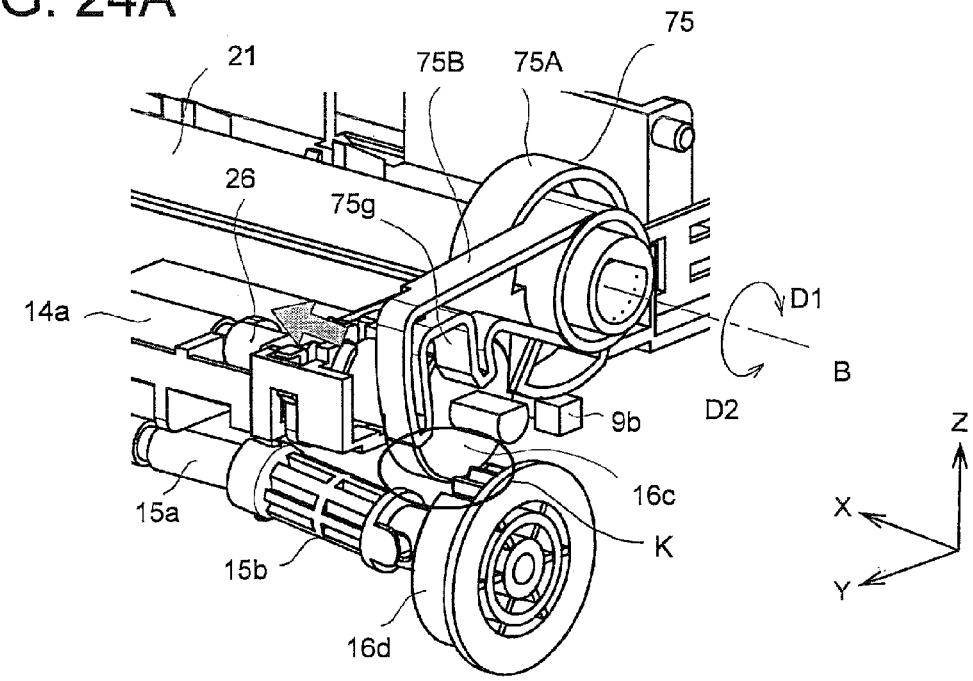
FIGS. 24A, 24B and 24C are a perspective view, a plan view and a front view showing a state where the cam member is rotated in the normal direction from the state shown in FIGS. 23A and 23B.
Figure 24B:
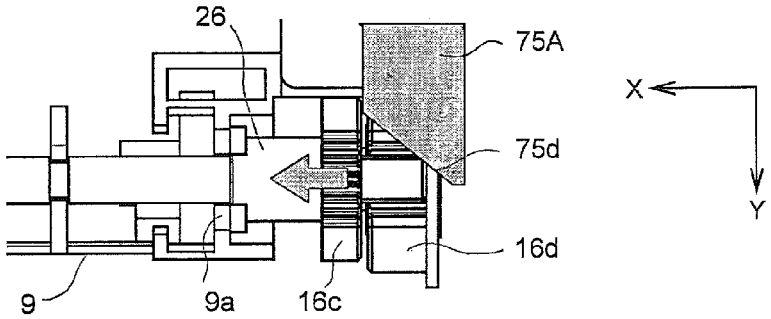
Figure 24C:
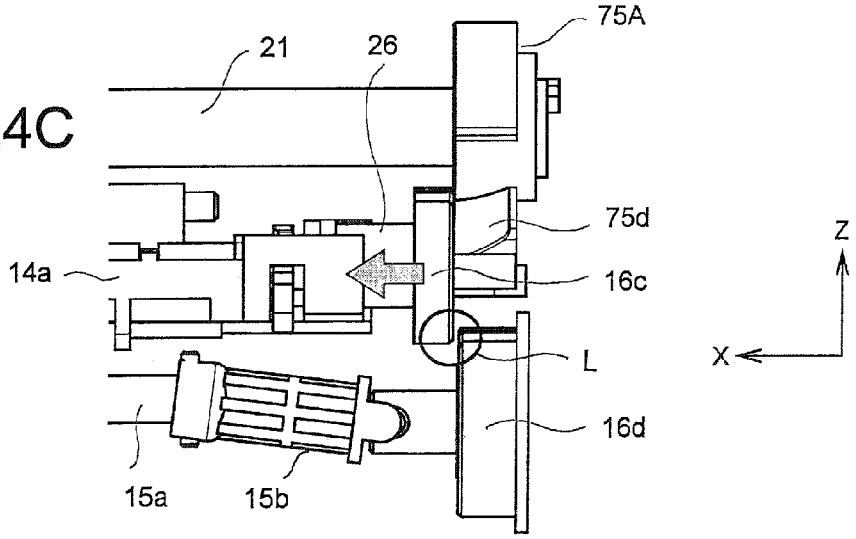

FIG. 24A is a perspective view showing a state where the cam member 75 further rotates in the normal direction (D1). FIG. 24B is a plan view showing the contact portion between the cam member 75 and the gear 16*c* and its surroundings as seen from above (i.e., from the +Z side). FIG. 24C is a front view showing the contact portion between the cam member 75 and the gear 16*c* and its surroundings as seen from front (i.e., from the +Y side).

When the rotation angle of the cam member 75 (from the reference angle) reaches 20 degrees, the gear 16*c* pushed by the cam surface 75*d* of the cam member 75 is released from meshing with the gear 16*d*. When the rotation angle of the cam member 75 reaches 25 degrees, the meshing between the gears 16*c* and 16*d* is completely released as shown by circles K and L in FIGS. 24A and 24C. In other words, the gears 16*c* and 16*d* are apart from each other.

In this regard, when the rotation angle of the cam member 75 reaches 25 degrees, the first groove portion 22*a* of the tilt lever 22 disengages from the boss 24*a* (see FIG. 7), and the engaging groove 75*g* of the lock lever portion 75B of the cam member 75 disengages from the boss 74 (FIG. 18). In other words, the locking of the upper frame unit 9 at the closing position is released. Accordingly, the meshing between the gears 16*c* and 16*d* is released in conjunction with an operation to release the locking of the upper frame unit 9 at the closing position.

Thereafter, when the upper frame unit 9 is rotated from the closing position to the opening position, the tilt lever 22 is not operated (rotated), and therefore the rotational position of the cam member 75 does not change. Accordingly, the gear 16*c* is kept displaced from the gear 16*d* in the +X direction.

Further, after the upper frame unit 9 reaches the opening position, when the tilt lever 22 is rotated (operated) in the normal direction (D1) as shown in FIG. 9 in order to lock the upper frame unit 9 at the opening position, the cam member 75 rotates. During this rotation of the cam member 75, the contact portion between the cam surface 75*d* and the gear 16*c* moves from a terminal end of the cam surface 75*d* to a flat surface of the protruding portion 75*f* (FIG. 19), and therefore a position of the gear 16*c* does not change. Accordingly, the gear 16 is held at a position displaced from the gear 16*d* in the +X direction.

Further, when the upper frame unit 9 rotates from the opening position to the closing position, the tilt lever 22 is not operated (rotated), and therefore the rotational position of the cam member 75 does not change. Accordingly, the gear 16*c* is held at the position displaced from the gear 16*d* in the +X direction.

Therefore, when the upper frame unit 9 reaches to the closing position, the gear 16*c* of the upper frame unit 9 is kept displaced from the gear 16*d* of the lower frame unit 8 in the +X direction. Thus, as in the first embodiment, the gears 16*c* and 16*d* are prevented from hitting each other.

Thereafter, as described in the first embodiment, the meshing between the gears 16*c* and 16*d* is switched.

To be more specific, when the tilt lever 22 is rotated in the normal direction (D2), the cam member 75 also rotates in the reverse direction (D2). When the cam member 75 rotates in the reverse direction (D2), the contact portion between the cam surface 75*d* and the gear 16*c* moves in the −X direction, and therefore the gear 16*c* moves in the −X direction by the biasing force of the coil spring 26.

When the rotation angle of the cam member 75 (from the reference angle) returns to 20 degrees, the gears 16*c* and 16*d* start meshing with each other. When the rotation angle of the cam member 75 (from the reference angle) returns to 2 degrees, the gears 16*c* and 16*d* completely mesh with each other. When the rotation angle of the cam member 75 returns to the reference angle (0 degree), the cam surface 75*d* of the cam member 75 separates from the gear 16*c* by the predetermined distance.

Advantages of Second Embodiment

As described above, according to the second embodiment, when the upper frame unit 9 is moved to the closing position with respect to the lower frame unit 8, the cam member 75 (i.e., a shift mechanism) holds the gear 16*c* at a position (i.e., a retracted position) where the gear 16*c* does not mesh with the gear 16*d*. Therefore, the gears 16*c* and 16*d* are prevented from hitting each other. Accordingly, as in the first embodiment, the gears 16*c* and 16*d* are prevented from being damaged.

Further, according to the second embodiment, the cam member 75 has the lock lever portion 75B. Therefore, the switching of the meshing of the gears 16*c* and 16*d* and the locking (releasing) of the upper frame unit 9 are performed using the same component (i.e., the cam member 75). As a result, manufacturing cost can be reduced.

In the above described embodiments, the image forming apparatus is configured to feed the medium 7 (i.e., the printing medium) and print an image on the medium 7 using the print head 10. However, the present invention is not limited to such a configuration. For example, the present invention is applicable to an image forming apparatus configured to feed a reading medium such as a document and read an image of the reading medium using a reading head.

Further, in the above described embodiments, the upper frame unit 9 is locked at the closing position by the tilt lever and the lock lever 23. However, if the image forming apparatus is not of a large size, it is also possible to lock the upper frame unit 9 at the closing position using the tilt lever 22 only (i.e., without using the lock lever 23).

Further, in the above described embodiments, the gear 16*c* of the rear upper roller 14 is moved in the X direction so as to prevent the gears 16*c* and 16*d* from hitting each other. However, it is also possible to move the gear 16*d* of the rear lower roller 15 instead of the gear 16*c*.

Further, in the above described embodiments, the upper frame unit 9 is rotatably supported by the lower frame unit 8. However, the present invention is not limited to such a configuration. The present invention is applicable to an image forming apparatus including a first unit and a second unit configured to be divisible (openable) at a medium feeding path provided therebetween.

In the above described embodiments, the configuration for preventing the gear 16*c* of the rear upper roller 14 and the gear 16*d* of the rear lower roller 15 from hitting each other. However, the present invention is not limited to such a configuration. The present invention is applicable to an image forming apparatus configured to prevent a gear of a first feeding member of a first unit and a gear of a second feeding member of a second unit from hitting each other.

Further, the cam profiles of the cam members 25 and 75 shown in FIGS. 13B and 20B are merely examples, but can be modified according to a specific configuration of the image forming apparatus.

The present invention is applicable to an image forming apparatus (for example, a printer, a copier, a facsimile machine and a multifunction peripheral) including a first unit and a second unit one of which is openable.

While the preferred embodiments of the present invention have been illustrated in detail, it should be apparent that modifications and improvements may be made to the invention without departing from the spirit and scope of the invention as described in the following claims.

What is claimed is:

1. An image forming apparatus comprising:

a first unit including a first feeding member for feeding a medium;

a second unit including a second feeding member for feeding the medium; and a medium feeding path provided between the first unit and the second unit, wherein the second unit is movable between a closing position where the medium feeding path is formed between the first unit and the second unit and an opening position where the second unit separates from the first unit so as to open the medium feeding path;

wherein the first feeding member has a first gear;

wherein the second feeding member has a second gear that meshes with the first gear when the second unit is in the closing position;

wherein the image forming apparatus further comprises a shift mechanism; and wherein when the second unit moves to the closing position, the shift mechanism holds one of the first gear and the second gear at a retracted position where the first gear and the second gear do not mesh with each other.

2. The image forming apparatus according to claim 1, further comprising a rotation locking mechanism that locks the second unit at least at the closing position.

3. The image forming apparatus according to claim 2, wherein in conjunction with an operation of the rotation locking mechanism to lock the second unit at the closing position, the shift mechanism moves the one of the first gear and the second gear from the retracted position to a meshing position where the first gear and the second gear mesh with each other.

4. The image forming apparatus according to claim 2, wherein in conjunction with an operation of the rotation locking mechanism to release locking of the second unit at the closing position, the shift mechanism moves the one of the first gear and the second gear to the retracted position.

5. The image forming apparatus according to claim 1, wherein the shift mechanism moves the one of the first gear and the second gear in a direction of a rotation axis of the one of the first gear and the second gear.

6. The image forming apparatus according to claim 5, further comprising:

a gear holding portion that holds the one of the first gear and the second gear so as to be movable in the direction of the rotation axis, and a biasing unit that biases the one of the first gear and the second gear to a position where the first gear and the second gear mesh with each other.

7. The image forming apparatus according to claim 1, further comprising a rotation locking mechanism that locks the second unit at least at the closing position, wherein the rotation locking mechanism includes a lever rotatably mounted to the second unit, and wherein the lever engages an engaging portion of the first unit.

8. The image forming apparatus according to claim 7, further comprising a shaft that extends along an axial direction of the one of the first gear and the second gear, the shaft rotating together with the lever of the rotation locking mechanism, wherein the shift mechanism includes a cam member mounted to the shaft, the cam member being contactable with the one of the first gear and the second gear, the cam member having a cam surface (25*d*, 75*d*), and wherein when the shaft rotates, the cam surface (25*d*, 75*d*) of the cam member pushes the one of the first gear and the second gear in the axial direction.

9. The image forming apparatus according to claim 8, wherein the cam member includes a lock portion that locks the second unit at the closing position.

10. The image forming apparatus according to claim 9, wherein when the rotation locking mechanism locks the second unit at the closing position, the lock portion also locks the second unit at the closing position.

11. The image forming apparatus according to claim 7, wherein the lever includes:

a first portion that engages the engaging portion when the second unit is in the closing position;

a second portion that guides the engaging portion when the second unit moves between the closing position and the opening position; and a third portion that engages the engaging portion when the second unit is in the opening position.

12. The image forming apparatus according to claim 7, wherein the shaft is a carriage shaft configured to guide a carriage having a head unit.

13. The image forming apparatus according to claim 7, wherein the lever functions as a stay that supports the second unit at the closing position.

14. The image forming apparatus according to claim 1, further comprising a connecting member that connects the other of the first gear and the second gear with the first feeding member or the second feeding member so as to be movable in a direction where the first feeding member or the second feeding member mesh with each other.

15. The image forming apparatus according to claim 1, wherein the second unit is provided above the first unit and is rotatably supported by the first unit.

16. The image forming apparatus according to claim 1, wherein the first feeding member and the second feeding member respectively include rollers.

* * * * *